US009139395B2

(12) United States Patent
Niikura et al.

(10) Patent No.: US 9,139,395 B2
(45) Date of Patent: Sep. 22, 2015

(54) ROTATABLE TRAY FOR SHEET PROCESSING APPARATUS

(71) Applicants: Yasuo Niikura, Kanagawa (JP); Keisuke Sugiyama, Tokyo (JP)

(72) Inventors: Yasuo Niikura, Kanagawa (JP); Keisuke Sugiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 32 days.

(21) Appl. No.: 13/925,055

(22) Filed: Jun. 24, 2013

(65) Prior Publication Data

US 2014/0011656 A1 Jan. 9, 2014

(30) Foreign Application Priority Data

Jul. 6, 2012 (JP) ..... 2012-152771

(51) Int. Cl.

| | |
|---|---|
| ***B65H 37/06*** | (2006.01) |
| ***B65H 29/00*** | (2006.01) |
| ***B65H 29/18*** | (2006.01) |
| ***B65H 29/26*** | (2006.01) |
| ***B65H 29/66*** | (2006.01) |
| ***B65H 31/02*** | (2006.01) |
| ***G03G 15/00*** | (2006.01) |

(52) U.S. Cl.

CPC ..... *B65H 29/00* (2013.01); *B65H 29/18* (2013.01); *B65H 29/26* (2013.01); *B65H 29/6618* (2013.01); *B65H 31/02* (2013.01); *G03G 15/6538* (2013.01); *B65H 2301/42144* (2013.01); *B65H 2405/1111* (2013.01); *B65H 2405/111646* (2013.01); *B65H 2405/2111* (2013.01); *B65H 2701/1932* (2013.01); *B65H 2801/27* (2013.01)

(58) Field of Classification Search

CPC ..... B65H 37/04; B65H 37/06
USPC ..... 270/58.07, 58.08, 58.11, 58.18; 399/410; 271/213, 217, 218
See application file for complete search history.

(56) References Cited

U.S. PATENT DOCUMENTS

| | | | | |
|---|---|---|---|---|
| 5,098,074 | A * | 3/1992 | Mandel et al. | 270/58.13 |
| 5,836,578 | A * | 11/1998 | Hirano et al. | 270/58.11 |
| 6,264,191 | B1 | 7/2001 | Suzuki et al. | |
| 6,290,220 | B1 * | 9/2001 | Takehara et al. | 270/58.12 |
| 6,296,247 | B1 | 10/2001 | Tamura et al. | |
| 6,371,471 | B1 * | 4/2002 | Fukazu et al. | 270/58.09 |
| 6,394,448 | B2 | 5/2002 | Suzuki et al. | |
| 6,428,000 | B1 * | 8/2002 | Hara et al. | 271/223 |
| 6,450,934 | B1 * | 9/2002 | Coombs | 493/383 |
| 7,487,964 | B2 | 2/2009 | Suzuki et al. | |
| 7,828,289 | B2 * | 11/2010 | Mumford | 271/207 |

(Continued)

FOREIGN PATENT DOCUMENTS

| | | |
|---|---|---|
| JP | 2006-143466 | 6/2006 |
| JP | 4179011 | 9/2008 |

(Continued)

*Primary Examiner* — Patrick Mackey
(74) *Attorney, Agent, or Firm* — Harness, Dickey & Pierce, P.L.C.

(57) ABSTRACT

A sheet processing apparatus comprises an ejecting unit configured to eject a sheet or a bundle of sheets, and a sheet stacking unit configured to stack the sheet or the bundle of sheets ejected by the ejecting unit. In the apparatus, the leading end portion of the sheet stacking unit on the downstream side in the sheet conveying direction is rotatable downward and capable of dropping down the sheet or the bundle of sheets stacked on the sheet stacking unit from the leading end portion of the sheet stacking unit.

16 Claims, 14 Drawing Sheets

(56) References Cited

U.S. PATENT DOCUMENTS

| | | | | |
|---|---|---|---|---|
| 8,573,582 | B2 * | 11/2013 | Miyake et al. | 270/58.1 |
| 2001/0050459 | A1 | 12/2001 | Tamura et al. | |
| 2002/0014733 | A1 * | 2/2002 | Miyake et al. | 270/58.08 |
| 2002/0063380 | A1 | 5/2002 | Tamura et al. | |
| 2010/0148416 | A1 | 6/2010 | Kayaba et al. | |
| 2013/0147105 | A1 * | 6/2013 | Sugiyama et al. | 270/45 |

FOREIGN PATENT DOCUMENTS

| | | |
|---|---|---|
| JP | 2010-143677 | 7/2010 |
| JP | 2013-121861 | 6/2013 |
| JP | 2013-154981 | 8/2013 |

* cited by examiner

ROTATABLE TRAY FOR SHEET PROCESSING APPARATUS

CROSS-REFERENCE TO RELATED APPLICATIONS

The present application claims priority to and incorporates by reference the entire contents of Japanese Patent Application No. 2012-152771 filed in Japan on Jul. 6, 2012.

BACKGROUND OF THE INVENTION

1. Field of the Invention

The present invention relates to a sheet processing apparatus that performs predetermined processing on a sheet recording medium that has been conveyed therein, such as a paper sheet, a recording sheet, a transfer sheet, and an overhead projector (OHP) sheet (simply referred to as a "sheet" herein and in the claims), and an image forming system including the sheet processing apparatus and an image forming apparatus such as a copying machine, a printer, a facsimile, and a digital multifunction peripheral (MFP).

2. Description of the Related Art

Conventional image forming systems have been widely used that include a sheet processing apparatus that performs predetermined processing such as middle folding processing and saddle stitch bookbinding processing. The middle folding processing folds a single sheet of an image formed sheet. The saddle stitch bookbinding (or binding) processing aligns a bundle of a plurality of sheets, staples the bundle of sheets, and thereafter folds them. In addition, the following sheet processing technology has already been known: the sheets or the bundle of sheets on which the middle folding processing or the saddle stitch binding processing has been performed are conveyed through the apparatus so that the folded portions of the sheets or the bundle of sheets are at the leading end in the sheet conveying direction, and then stacked on a stacking tray in a state in which the sheets or the bundles of sheets partially overlap with each other.

The conventional technologies as described above are publicly known and disclosed in Japanese Patent No. 4179011 and Japanese Patent Application Laid-open No. 2010-143677, for example. A sheet processing apparatus as described below is disclosed in Japanese Patent No. 4179011. The sheet processing apparatus aims to stack bundles of sheets that have been bundled and folded in two parts in order, regardless of the size of the sheets, on a book tray. The sheet processing apparatus includes a sheet receiving unit, a sheet bundling unit, a sheet folding unit, a sheet stacking unit. The sheet stacking unit stacks the bundles of sheets, each of which has been folded by the sheet folding unit that folds the bundles of sheets, each of which has been bundled by the sheet bundling unit that bundles the sheets, each of which has been placed on the sheet receiving unit that receives a sheet from an image forming apparatus. A conveying roller member is provided above the sheet stacking unit of the sheet processing apparatus. The conveying roller member conveys the bundle of sheets folded by the sheet folding unit downward the sheet stacking unit. The sheet processing apparatus also includes a sheet size recognition unit that recognizes the size of a sheet placed on the sheet receiving unit. The sheet stacking unit includes a sheet conveying member. While the sheet stacking unit consecutively places each of the bundles of sheets conveyed from above by the conveying roller member, the sheet conveying member moves each of the bundles of sheets placed on the sheet stacking unit step by step. According to the recognition result of the size of the sheet, the conveying distance in a step of the sheet conveying member for sequential conveyance of the bundles of sheets can be changed.

A sheet stacking unit with the following structure is disclosed in Japanese Patent Application Laid-open No. 2010-143677. The sheet stacking unit stacks the bundles of sheets including a plurality of sheets on which folding processing has been performed in a state in which the bundles of sheets partially overlap with each other. This aims to solve the problem that the bundle of the sheets on which folding processing has been performed tends to swell and the folded portion of the bundle of the sheets tend to open in an ejecting tray at a slant, and to appropriately stack the bundles of the sheets under such poor conditions. The sheet stacking unit includes a sheet placement portion, a sheet conveying unit, a sheet position detection means, a sheet holding means, and a control unit. The sheet placement portion is provided so that the downstream side in the sheet conveying direction of the sheet placement portion in the sheet conveying direction is higher than the opposite side and stacks the bundle of sheets on which folding processing has been performed. The sheet conveying unit conveys the bundles of sheets stacked on the sheet placement portion and overlapping with each other. The sheet position detection means detects that the trailing end of the bundle of sheets has reached a predetermined standby position on the sheet placement portion. The sheet holding means is provided swingably or slidably on the upstream side of the sheet placement portion and includes a sheet contact portion that contacts the top surface of the bundles of sheets stacked on the sheet placement portion. The control unit controls the sheet conveying unit. When a conveyed bundle of sheets overlaps onto another bundle of sheets on which folding processing has been performed and stacked on the sheet placement portion, the control unit controls the sheet conveying unit to convey the bundle of sheets, on which folding processing has been performed, stacked on the sheet placement portion, in the sheet conveying direction. If the sheet position detection means detects that the trailing end of the bundle of sheets, on which folding processing has been performed, has reached the predetermined standby position on the sheet placement portion, the control unit controls the sheet conveying unit to stop.

Japanese Patent No. 4179011 and Japanese Patent Application Laid-open No. 2010-143677 disclose the following sheet processing technologies for conveying and stacking sheets. Specifically, the bundles of sheets on which middle folding processing or saddle stitch binding processing has been performed, are conveyed so that the folded portions of the bundles of sheets are at the leading end in the sheet conveying direction. A part of a stacking tray is stored below to enable users to output a large amount of bundles of sheets and eject them without limitation.

Japanese Patent No. 4179011 discloses the following structure. The bundles of sheets are sequentially conveyed by the sheet conveying member in a state in which the bundles of sheets partially overlap with each other so that the bundles of sheets are stacked on a saddle stitch binding stacking tray in order, regardless of the size of the sheets. According to the recognition result of the size of the sheet, the conveying distance for sequential conveyance of the bundles of sheets can be changed. In the invention disclosed in Japanese Patent No. 4179011, however, it is not taken into account that the bundles of sheets are dropped from above the sheet stacking unit to store the bundles of sheets in a storage box.

When a user performs limitless ejecting, in which the bundles of sheets are dropped down from the sheet stacking unit into the storage box, as described in Japanese Patent No. 4179011, the bundles of sheets may open after being dropped down. When the subsequent bundles of sheets are dropped down in this state, the preceding bundles of sheets may be damaged.

Japanese Patent Application Laid-open No. 2010-143677 discloses the structure for appropriately stacking bundles of sheets on a sheet placement portion that is tilted so that the downstream side in the sheet conveying direction is higher than the opposite side. In the invention disclosed in Japanese Patent Application Laid-open No. 2010-143677, however, it is not taken into account that the bundles of sheets are dropped from above the sheet placement portion to store the bundles of sheets in a storage box. When a user performs limitless ejecting, in which the bundles of sheets are dropped down from the sheet placement portion into the storage box, the bundles of sheets may open after being dropped down in the same manner as described in Japanese Patent No. 4179011. When the subsequent bundles of sheets are dropped down in this state, the preceding bundles of sheets may be damaged.

In the examples disclosed in Japanese Patent No. 4179011 and Japanese Patent Application Laid-open No. 2010-143677, the bundles of sheets dropped down from the sheet stacking unit into the storage box are not aligned with each other because they are stacked or stored therein in the state as they are when dropped down. The bundles of sheets are stored in such a state that they are not aligned with each other, therefore, a user has to take the bundles of sheets out of the storage box and manually align them with each other.

The embodiment according to the present invention aims to prevent a user from manually aligning the bundles of sheets dropped down from the sheet stacking unit and stacked, and prevent the dropped bundles of sheets from being damaged.

SUMMARY OF THE INVENTION

It is an object of the present invention to at least partially solve the problems in the conventional technology.

According to the present invention, there is provided: a sheet processing apparatus comprising an ejecting unit configured to eject a sheet or a bundle of sheets; and a sheet stacking unit configured to stack the sheet or the bundle of sheets ejected by the ejecting unit, wherein the leading end portion of the sheet stacking unit on the downstream side in the sheet conveying direction is rotatable downward and capable of dropping down the sheet or the bundle of sheets stacked on the sheet stacking unit from the leading end portion of the sheet stacking unit.

The present invention also provides an image forming system comprising a sheet processing apparatus.

In the above-mentioned image forming system, the sheet processing apparatus comprises an ejecting unit configured to eject a sheet or a bundle of sheets, and a sheet stacking unit configured to stack the sheet or the bundle of sheets ejected by the ejecting unit, wherein the leading end portion of the sheet stacking unit on the downstream side in the sheet conveying direction is rotatable downward and capable of dropping down the sheet or the bundle of sheets stacked on the sheet stacking unit from the leading end portion of the sheet stacking unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention is characterized in that: a sheet stacking unit is tilted so that the leading end portion on the downstream side in the sheet conveying direction of the sheet stacking unit, e.g., the leading end portion of a sheet stacking auxiliary unit is lower than the horizontal line (the stacking surface of the sheet stacking unit) that passes through the connected portion (base end portion) between the sheet stacking unit and the sheet stacking auxiliary unit; bundles of sheets are slid along this slope; and bundles of sheets are ejected in a sheet stacking box placed below the leading end portion of a sheet stacking auxiliary unit.

The embodiment of the present invention will be hereinafter described with reference to the accompanying drawings.

Figure 1:
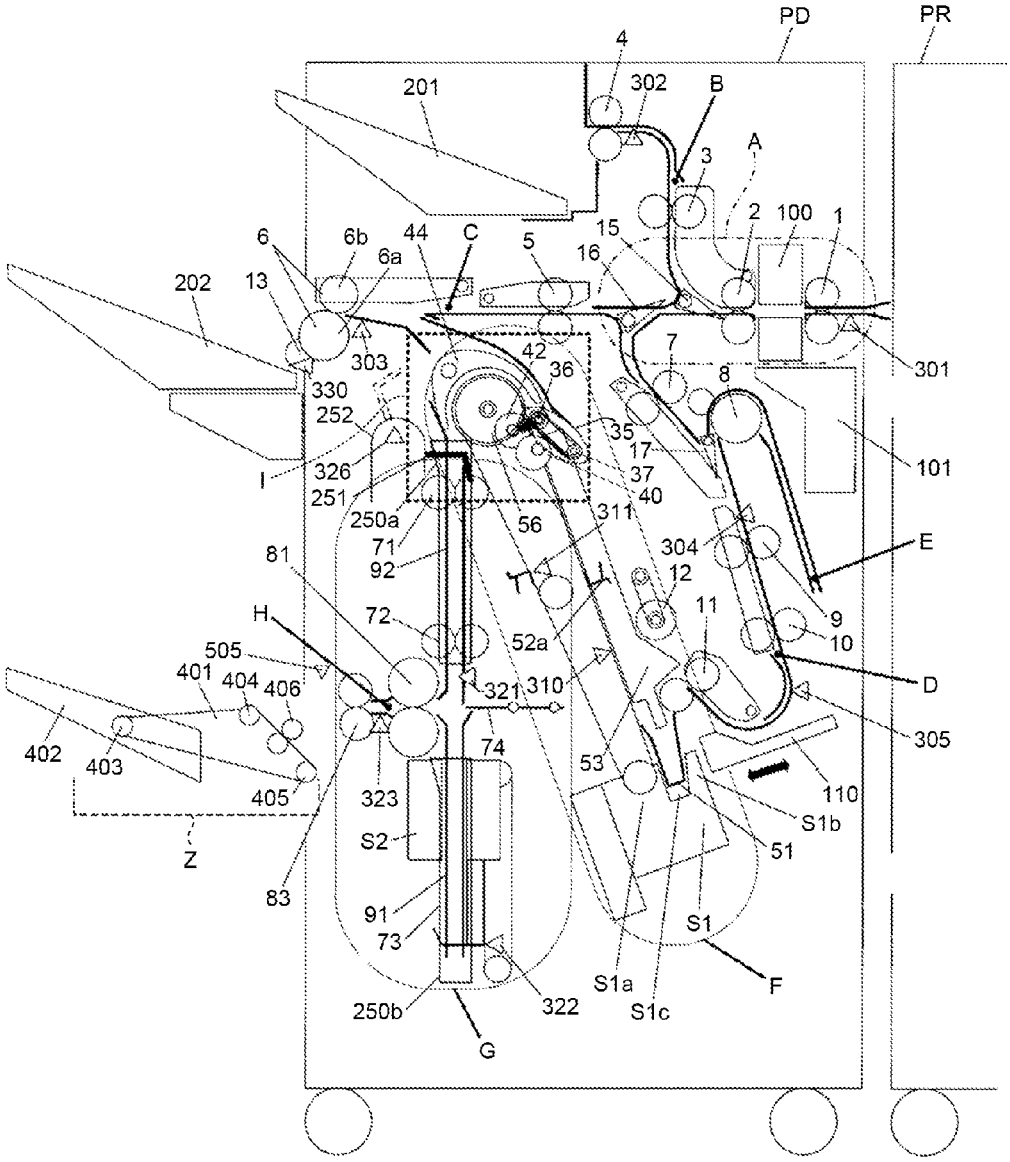
FIG. 1 is the structure diagram of an image forming system including a sheet post-processing apparatus and an image forming apparatus according to an embodiment of the present invention.

FIG. 1 is the structure diagram of an image forming system including a sheet post-processing apparatus PD as a sheet processing apparatus and an image forming apparatus PR according to an embodiment of the present invention. As illustrated in FIG. 1, the image forming apparatus PR includes an image processing circuit, an optical writing device, a developing unit, a transfer unit, and a fixing unit. The image processing circuit converts image data that has been input (not illustrated) into printable image data. The optical writing device performs optical writing on a photosensitive element according to image signals that are output from the image processing circuit. The developing unit develops latent images formed on the photosensitive element through the optical writing into toner images. The transfer unit transfers toner images developed by the developing unit onto a sheet. The fixing unit fixes toner images transferred onto the sheet. The sheet on which toner images are fixed is fed to the sheet post-processing apparatus PD that performs intended post-processing on the sheet.

The image forming apparatus PR is an electrophotography image forming apparatus as described above, however, any type of image forming apparatus publicly known can be used including an inkjet image forming apparatus and a thermal transfer image forming apparatus. In the embodiment, an image forming unit includes the image processing circuit, the optical writing device, the developing unit, the transfer unit, and the fixing unit.

The sheet post-processing apparatus PD is installed on the side of the image forming apparatus PR. A sheet ejected from the image forming apparatus PR is guided to the sheet post-processing apparatus PD that includes a conveying path A, a conveying path B, a conveying path C, a conveying path D, and a conveying path H. The sheet is firstly conveyed to the conveying path A that has a post-processing unit (a punching unit 100 in the embodiment) for performing post-processing on a single sheet.

The conveying path B guides the sheet through the conveying path A to an upper tray 201, and the conveying path C guides the sheet to a shift tray 202. The conveying path D guides the sheet to a processing tray F on which alignment processing and staple binding processing are performed (hereinafter, also referred to as an "end staple processing tray"). The sheets are guided from the conveying path A to the conveying path B, C, or D by way of a branching claw 15 and a branching claw 16 in a distributed manner.

This sheet post-processing apparatus can perform various types of processing on the sheet, e.g., punching (punching unit 100), sheet alignment+end stapling (a jogger fence 53 and an end stapler S1), sheet alignment+saddle stitch binding (a saddle stitch binding upper jogger fence 250*a*, a saddle stitch binding lower jogger fence 250*b*, and a saddle stitch binding stapler S2), sheet sorting (the shift tray 202), middle folding (a folding plate 74, the middle folding rollers 81). According to intended processing, the conveying path A, the subsequent conveying paths B, C, and D are selected. The conveying path D includes a sheet accommodating section E, and an end staple processing tray F, a saddle stitch binding and middle folding processing tray G, an ejecting conveying path H are provided on the downstream side in the sheet conveying direction of the conveying path D.

Along the conveying path A, which is located on the upstream side in the sheet conveying direction of and common to the conveying path B, the conveying path C, and the conveying path D, the following components are arranged in this order: an inlet sensor 301, an inlet rollers 1 on the downstream side in the sheet conveying direction of the inlet sensor 301, the punching unit 100, a punch waste hopper 101, conveying rollers 2, a first branching claw 15 and a second branching claw 16. The inlet sensor 301 detects a sheet received from the image forming apparatus PR. The first branching claw 15 and the second branching claw 16 are maintained in the state (the initial state) as illustrated in FIG. 1 by springs (not illustrated). The branching claw 15 is driven by turning on a first solenoid (not illustrated) and the branching claw 16 is driven by turning on a second solenoid (not illustrated). By turning on and off the first solenoid and the second solenoid, branching directions determined by the orientation of the first branching claw 15 and the second branching claw 16 are changed, thereby changing a combination of the branching directions for the conveying paths. As a result, the sheet or the sheets are distributed to the conveying path B, the conveying path C, or the conveying path D.

To guide the sheets to the conveying path B, the first solenoid is kept turned off (the branching claw 15 faces down in the initial state) in the state illustrated in FIG. 1. The sheets are conveyed through conveying rollers 3 and ejecting rollers 4 to the upper tray 201.

To guide the sheets to the conveying path C, the first solenoid and the second solenoid are both turned on from the state illustrated in FIG. 1 (the branching claw 16 faces up in the initial state). The branching claw 15 swings upward and the branching claw 16 swings downward. The sheets are ejected through the conveying rollers 5 and the ejecting rollers 6 (6*a* and 6*b*) to the shift tray 202. The sheets are sorted this time. Sheet sorting is performed in a shift tray ejecting unit located at the most downstream side of the sheet post-processing apparatus PD. The sheet sorting is performed through a pair of shift ejecting rollers 6 (6*a* and 6*b*), a returning roller 13, a sheet-surface detection sensor 330, the shift tray 202, a shifting mechanism (not illustrated) that reciprocates the shift tray 202 in the direction perpendicular to the sheet conveying direction, and a shift tray lifting and lowering mechanism (not illustrated) that moves the shift tray 202 up and down.

To guide the sheets to the conveying path D, the first solenoid driving the first branching claw 15 is turned on so that the branching claw 15 swings upward. The second solenoid driving the second branching claw 16 is turned off so that the branching claw 16 swings downward. Then, the sheets are conveyed through the conveying rollers 2 and conveying rollers 7 to the conveying path D. The sheets that have been guided to the conveying path D are then guided to the end staple processing tray F. After being aligned and stapled in the end staple processing tray F, the sheets are distributed by a guiding member 44 to the conveying path C that leads to the shift tray 202 or the saddle stitch binding and middle folding processing tray G (hereinafter, also referred to as simply a "saddle stitch binding processing tray") that performs folding and other processing. When the sheets are guided to the shift tray 202, bundles of sheets are ejected through the pair of ejecting rollers 6 to the shift tray 202. Bundles of sheets that have been guided to the saddle stitch binding processing tray G are folded and stapled on the saddle stitch binding processing tray G, pass through the ejecting conveying path H, and are ejected through a pair of ejecting rollers 83 to a saddle stitch binding stacking tray unit Z.

A branching claw 17 is provided in the conveying path D and maintained in the state as illustrated in FIG. 1 by a low-load spring (not illustrated). After the trailing end of the sheet conveyed by the conveying rollers 7 passes through the branching claw 17, at least conveying rollers 9 among the conveying rollers 9, conveying rollers 10, and an ejecting-to-stapler rollers 11 are reversed, to reverse the sheets along a turn guide 8. The trailing edge of the sheet is guided, therefore, to a sheet accommodating section E in which sheets are stored to be accumulated (pre-stack), which enables conveying sheets piled on the subsequent sheets. Repetition of this operation enables two or more piled sheets to be conveyed. The numeral 304 in FIG. 1 indicates a pre-stack sensor for setting a timing of reversal conveyance of sheets when pre-stacking sheets.

The sheets are guided to the conveying path D and then guided to the end staple processing tray F by the ejecting-to-stapler rollers 11 if sheet alignment processing and end staple processing will be performed. The sheets are sequentially stacked on the end staple processing tray F thereafter. The sheets are aligned in the longitudinal direction (the sheet conveying direction) by a tapping roller 12 and aligned in the lateral direction (in the direction perpendicular to the sheet conveying direction, also referred to as the sheet width direction) by the jogger fence 53. At an interval between jobs, that is, from the time when the last sheet of the bundle of sheets is processed to the time when the first sheet of the bundle of sheets is processed, the end stapler S1 as a staple unit is driven by a staple signal from a control device (not illustrated) to perform staple processing. The bundle of sheets on which the staple processing has been performed are immediately conveyed to ejecting-to-shift rollers 6 by a discharging belt 52 having a projected discharging claws 52*a* (refer to FIG. 2) and ejected to the shift tray 202 installed at the receiving position.

The end stapler S1 includes, as illustrated in FIG. 1, a stitcher (driver) S1*a* that puts out a stapler pin and a clincher S1*b* that bends the leading ends of the stapler pin. A space S1*c* is formed between the stitcher S1 and the clincher S1*b*, through which the trailing-end reference fences 51*a* and 51*b* can pass. The end stapler S1 moves therefore without interfering with the trailing-end reference fences 51*a* and 51*b*. The stitcher S1*a* and the clincher S1*b* are integrated in the end stapler S1, unlike the saddle stitch binding stapler S2. The stitcher S1*a* serves as a fixed side, which does not move in a vertical direction with respect to the sheets, and the clincher S1*b* serves as a moving side, which moves in a vertical direction with respect to the sheets. When a stapling operation is performed on a bundle of sheets SB, the clincher S1*b* moves toward the stitcher S1*a* at a predetermined portion to be stapled of the bundles of sheets SB that is contacted with the stacking surfaces 51*a*1 and 51*b*1 of the trailing-end reference fence 51, during the process in which the stapling operation is performed.

Figure 2:
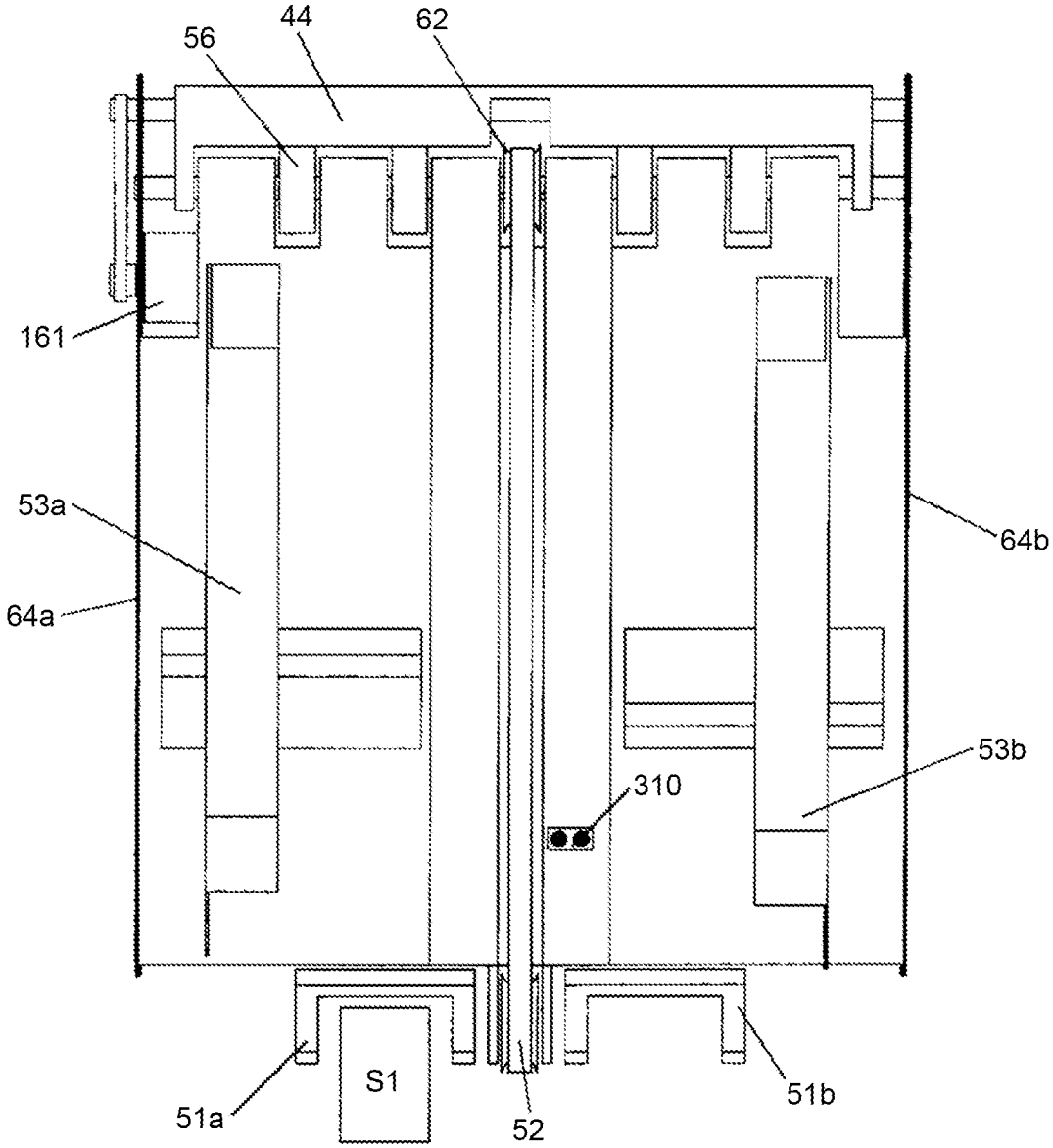
FIG. 2 is the schematic structure diagram of an end staple processing tray illustrated in FIG. 1 viewed from the stacking surface side of the tray according to the embodiment.
Figure 4:
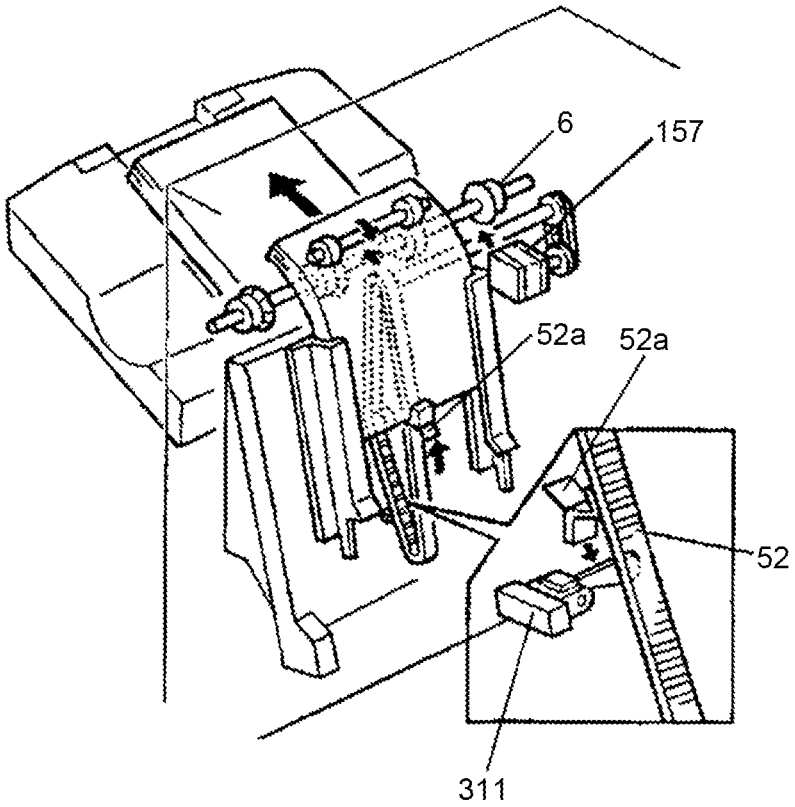
FIG. 4 is a perspective view of operations of a discharging belt illustrated in FIG. 1 according to the embodiment.

The discharging belt 52 is located, as illustrated in FIGS. 2 and 4, at the center of the aligned sheet width direction and stretched between pulleys 62. The discharging belt 52 is driven by a discharging belt driving motor 157. A plurality of discharging rollers 56 are arranged symmetrically with respect to the discharging belt 52 and provided rotatably around a driving shaft, thereby functioning as driven rollers.

The home position of the discharging claws 52*a* can be detected by a discharging belt home position (HP) sensor 311, which is turned on and off by the discharging claws 52*a* provided on the discharging belt 52. Two discharging claws 52*a* are located at the positions facing each other on the outer circumference of the discharging belt 52. The two discharging claws 52*a* alternatively move and convey the bundles of sheets accommodated in the end staple processing tray F. The discharging belt 52 is reversed as necessary to align the discharging claw 52*a* standing by for moving the bundles of sheets and the leading end in the conveying direction of the bundles of sheets accommodated in the end staple processing tray F, on the back side of the discharging claw 52*a* facing the other discharging claw 52*a* described above.

The numeral 110 illustrated in FIG. 1 indicates a trailing end pressing lever, which is located at the lower end of the trailing-end reference fence 51 so as to press the trailing end of the bundle of sheets SB accommodated in the trailing-end reference fence 51. The trailing end pressing lever 110 reciprocates in a direction nearly perpendicular to the end staple processing tray F. Each of the sheets ejected to the end staple processing tray F is aligned (in the sheet conveying direction) by the tapping roller 12. If the trailing end of the sheets stacked on the end staple processing tray F are curled or weak, the trailing end of the sheets tends to buckle due to its own weight and the sheets tend to swell. In addition, as the number of stacked sheets increases, the space for accommodating another sheet in the trailing-end reference fence 51 is narrowed, whereby the alignment of the trailing end of the sheets in the longitudinal direction tends to deteriorate. A trailing end pressing mechanism is therefore provided to suppress the swell of the trailing end of the sheets so that a sheet can readily enter the space between the sheets and the trailing-end reference fence 51. The trailing end pressing lever 110 directly presses the sheets for that purpose.

With reference to FIG. 1, the numerals 302, 303, 304, 305, and 310 indicate sheet detection sensors. Each of them detects passage of sheets or stacking of sheets, depending on the position where the sheet detection sensor is located.

Figure 6:
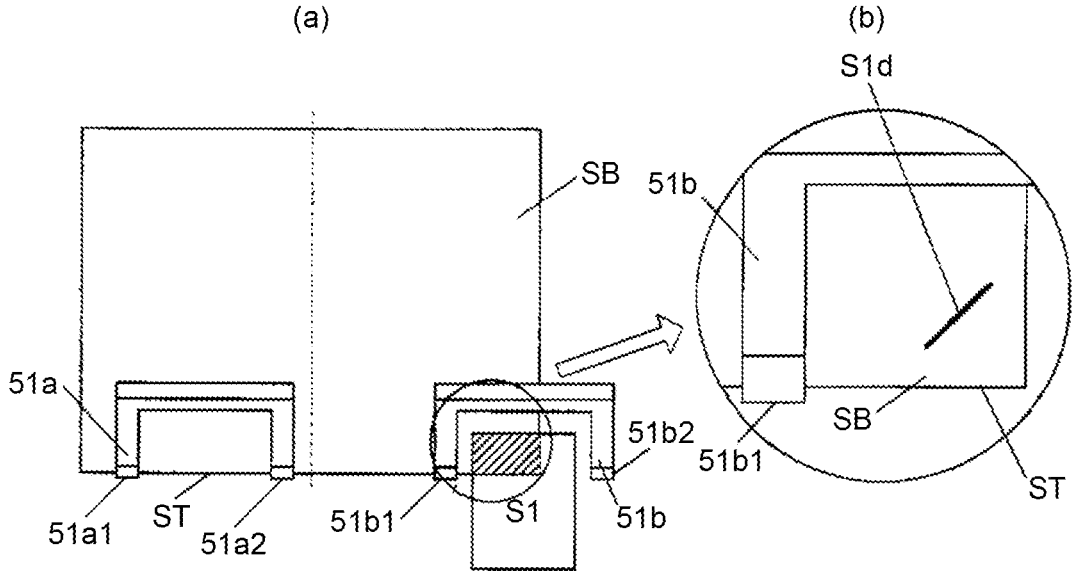
FIGS. 6(*a*) and 6(*b*) are views illustrating a positional relation among sheets stacked on the end staple processing tray, standard fences, and an end stapler when end staple processing is performed according to the embodiment.

FIG. 2 is the schematic structure diagram of the end staple processing tray F illustrated in FIG. 1 viewed from the stacking surface side of the tray (viewed from the right side of FIG. 1). With reference to FIG. 2, the sheets received from the image forming apparatus PR on the upstream side are aligned in the width direction by the jogger fences 53*a* and 53*b*, and aligned in the longitudinal direction by being abutted to the first trailing-end reference fence 51*a* and the second trailing-end reference fence 51*b* (indicated with the numeral 51 in FIG. 1). FIGS. 6(*a*) and 6(*b*) are views illustrating the positional relation among sheets stacked on the end staple processing tray F, the trailing-end reference fences 51*a* and 51*b*, and the end stapler S1 when end staple processing is performed. As illustrated in FIG. 6, the sheet trailing end ST contacts both the first trailing-end reference fence 51*a* and the second trailing-end reference fence 51*b* at the inside thereof. The first trailing-end reference fence 51*a* includes stacking surfaces 51*a*1 and 51*a*2 and the second trailing-end reference fence 51*b* includes stacking surfaces 51*b*1 and 51*b*2 for supporting the sheet trailing end ST. The sheets can be supported at four points as illustrated in FIG. 2, however, when the end stapler S1 staples the sheets at a point at an angle, the end stapler S1 moves to the end of the stacked bundle of sheets SB and performs staple processing at an angle. The FIG. 6B illustrates the relation between a stapler pin S1*d* after the staple processing and the second trailing end fence 51*b*. During the staple processing, the bundles of sheet SB are stacked while contacting any two of the stacking surfaces 51*a*1, 51*a*2, and 51*b*1 as illustrated in FIG. 6A. This aims to suppress mechanical errors including errors in installation accuracy of the trailing end fences 51*a* and 51*b*. The sheets can be further stabilized by being supported at two points.

After an alignment operation is completed, the end stapler S1 performs the staple processing on the bundles of sheets. Subsequently, as illustrated in a perspective view of operations of the discharging belt in FIG. 4, the discharging belt 52 is driven to rotate counterclockwise by the discharging belt driving motor 157, whereby the bundle of sheets after the staple processing is scooped with the discharging claw 52*a* attached to the discharging belt 52 and ejected from the end staple processing tray F. The numeral 64*a* indicates a front side plate and the numeral 64*b* indicates a rear side plate. This operation can also be applied to a bundle of sheets on which the staple processing is not performed after the alignment.

Figure 3:
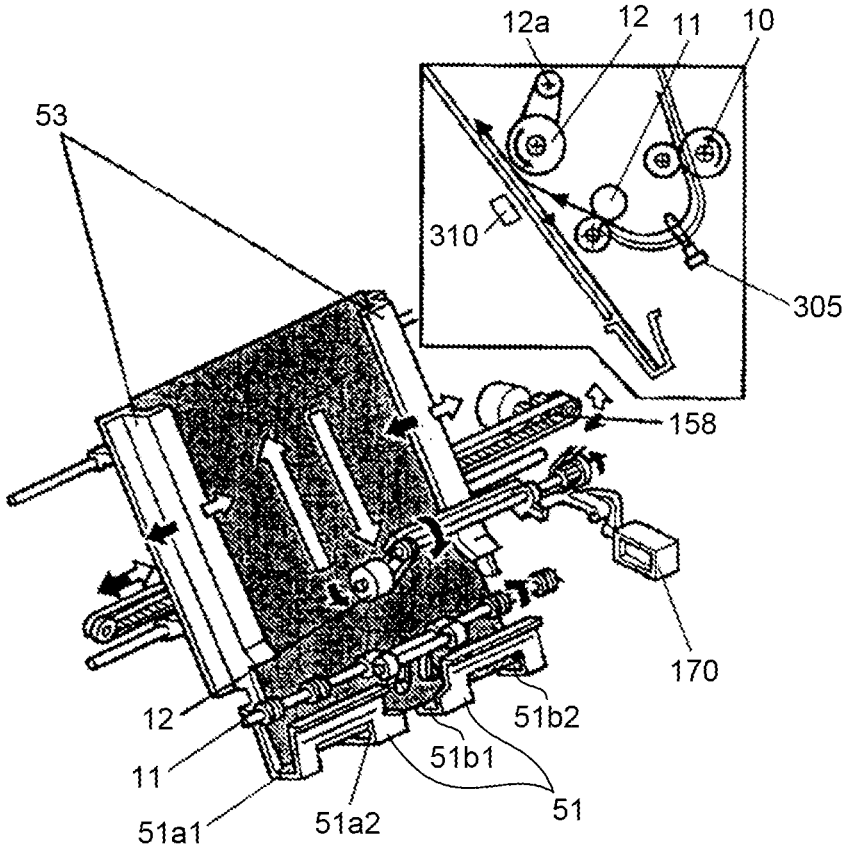
FIG. 3 is a perspective view of the schematic structure of the end staple processing tray illustrated in FIG. 2 and its attached mechanism according to the embodiment.

FIG. 3 is a perspective view of the schematic structure of the end staple processing tray F and its attached mechanism. As illustrated in FIG. 3, the sheets guided to the end staple processing tray F by the ejecting-to-stapler rollers 11 are sequentially stacked on the end staple processing tray F. If a single sheet is ejected onto the end staple processing tray F the sheet is aligned in the longitudinal direction (the sheet conveying direction) by the tapping roller 12, and aligned in the width direction (i.e., the sheet width direction perpendicular to the sheet conveying direction) by the jogger fences 53*a* and 53*b*. The tapping roller 12 has a pendulum motion about a fulcrum 12*a* due to the function of a tapping solenoid (SOL) 170. The pendulum motion of the tapping roller 12 acts on the sheet fed onto the end staple processing tray F intermittently, thereby abutting the sheet trailing end ST to the trailing-end reference fence 51. The tapping roller 12 itself rotates counterclockwise. The jogger fences 53 are provided so that the jogger fences 53*a* and 53*b* oppose each other in the front and back side of the end staple processing tray F as illustrated in FIG. 2 and FIG. 3. The jogger fences 53 are driven through a timing belt by a jogger motor 158 that is rotatable forward and backward, thereby reciprocating in the sheet width direction.

Figure 5:
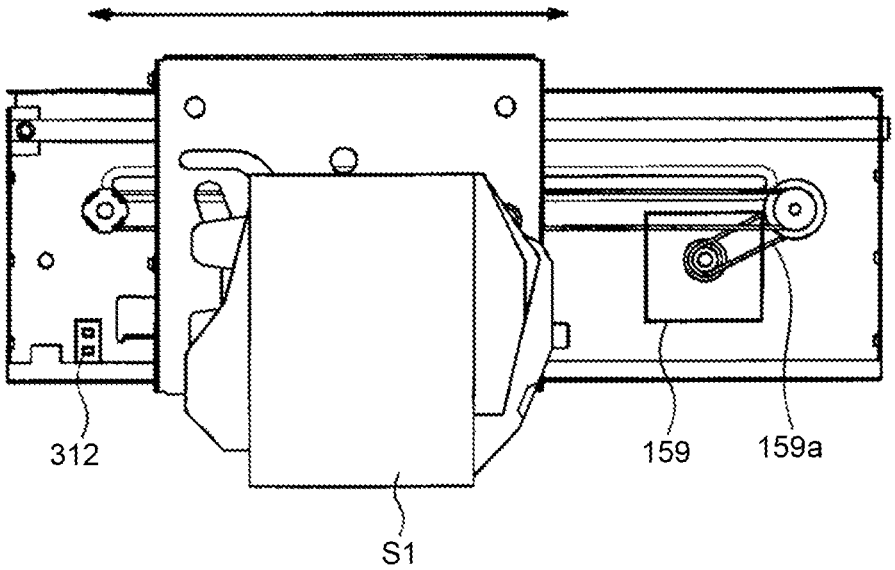
FIG. 5 is a side view of a movement mechanism of a stapler illustrated in FIG. 1 according to the embodiment.

FIG. 5 is a side view of a movement mechanism of a stapler in the sheet width direction. The end stapler S1 is driven through a timing belt 159*a* by a stapler moving motor 159 that is rotatable forward and backward as illustrated in FIG. 5, and moves in the sheet width direction to staple the sheets at a predetermined position in the trailing end portion of the sheets. At one end of the travel range of the end stapler S1, a stapler movement home position (HP) sensor 312 is provided that detects the home position of the end stapler S1. The staple position of the sheets in the sheet width direction is controlled according to the travel of the end stapler S1 from its home position. The end stapler S1 can staple the sheets at one or more locations (typically two) in the trailing end portion of the sheets. The end stapler S1 can travel across at least the entire width of the sheet trailing end ST supported by the trailing-end reference fences 51*a* and 51*b*. The end stapler S1 can also travel up to the maximum distance in the front of the apparatus so that a user can readily replace stapler pins in the end stapler S1.

A bundle of sheets deflection mechanism I is provided on the downstream side in the sheet conveying direction of the end staple processing tray F. As illustrated in FIG. 1, conveying paths from the end staple processing tray F to the saddle stitch binding processing tray G and from the end staple processing tray F to the shift tray 202 are provided, and a conveying unit for conveying the bundles of sheets SB from the end staple processing tray F through the conveying paths are also provided. These conveying paths and the conveying unit include a conveying mechanism 35 that provides the bundle of sheets SB with conveying force, the discharging rollers 56 that turn the bundle of sheets SB, and the guiding member 44 that guides the bundle of sheets SB to be turned.

These components will now be described in detail. The driving force of a driving shaft 37 is transmitted through a timing belt to a roller 36 in the conveying mechanism 35. The roller 36 and the driving shaft 37 are coupled and supported by an arm, and the roller 36 is movable about the driving shaft 37 as a rotary fulcrum. The swing motion of the roller 36 in the conveying mechanism 35 is driven by a cam 40 that rotates around the axis of rotation and is driven by a motor (not illustrated). A driven roller 42 is arranged at the position facing the roller 36 in the conveying mechanism 35. The driven roller 42 and the roller 36 sandwich the bundle of sheets, which are then pressed by an elastic member. This provides the bundle of sheets with conveying force.

The conveying path for turning the bundle of sheets from the end staple processing tray F to the saddle stitch binding processing tray G is formed between the discharging rollers 56 and the inner surface of the guiding member 44 on the side facing the discharging roller 56. The guiding member 44 rotates about the fulcrum, whose driving force is transmitted from a bundle branching drive motor 161 (refer to FIG. 2). When the bundle of sheets are conveyed from the end staple processing tray F to the shift tray 202, the guiding member 44 rotates about the fulcrum clockwise in the diagram. The space between the outer surface of the guiding member 44 (the side not facing the discharging roller 56) and a guide plate on the outside of the guiding member 44 functions as a conveying path. When feeding the bundle of sheets SB from the end staple processing tray F to the saddle stitch binding processing tray G, the trailing end of the bundle of sheets SB that have been aligned by the end staple processing tray F is pressed upward by the discharging claw 52*a*, and the bundle of sheets are sandwiched between the roller 36 of the conveying mechanism 35 and the driven roller 42 facing the roller 36. This provides the bundle of sheets with conveying force. The roller 36 of the conveying mechanism 35 at this time stands by on such a position so as not to abut the leading end portion of the bundles of sheets SB. After the leading end portion of the bundles of sheets SB passed through the roller 36, the roller 36 of the conveying mechanism 35 comes in contact with the surface of the sheets to provide the bundle of sheets with conveying force. At this time, the guiding member 44 and the discharging rollers 56 form a guide to the conveying path for turning the bundle of sheets SB to convey it to the saddle stitch binding processing tray G on the downstream in the sheet conveying direction.

The saddle stitch binding processing tray G is provided on the downstream side in the sheet conveying direction of the bundle of sheets deflection mechanism including the conveying mechanism 35, the guiding member 44, and the discharging rollers 56, as illustrated in FIG. 1. The saddle stitch binding processing tray G is provided on the downstream side in the sheet conveying direction of the bundle of sheets deflection mechanism in a nearly vertical direction, including a middle folding mechanism in the center, a bundle conveying guide upper plate 92 thereabove, and a bundle conveying guide lower plate 91 therebelow.

Bundle conveying upper rollers 71 are provided on the upper side of the bundle conveying guide upper plate 92, and bundle conveying lower rollers 72 are provided on the lower side of the bundle conveying guide upper plate 92. Along the side surface of the bundle conveying guide upper plate 92, saddle stitch upper jogger fences 250*a* are provided across the bundle conveying upper rollers 71 and the bundle conveying lower rollers 72. In the same manner, along the side surface of the bundle conveying guide lower plate 91, saddle stitch lower jogger fences 250*b* are provided, where the saddle stitch binding stapler S2 is arranged. The saddle stitch upper jogger fences 250*a* and the saddle stitch lower jogger fences 250*b* are driven by a driving mechanism (not illustrated) and perform an alignment operation in the direction orthogonal to the sheet conveying direction (the width direction of the sheet). The saddle stitch binding stapler S2 includes a clincher and a driver forming one pair, two pairs of which are provided with a predetermined interval interposed in the width direction of the sheet.

A movable rear-end reference fence 73 is arranged across the bundle conveying guide lower plate 91 and movable in the sheet conveying direction (up and down direction in the diagram) due to a movement mechanism including a timing belt and its driving mechanism. The driving mechanism includes driving pulleys between which the timing belt is stretched, a driven pulley, and a stepping motor that drives the driving pulleys as illustrated in FIG. 1. In the same manner, a rear end tapping claw 251 and its driving mechanism are provided on the upper end of the bundle conveying guide upper plate 92. The rear end tapping claw 251 can reciprocate, due to a timing belt 252 and a driving mechanism (not illustrated), between the direction departing from the bundle of sheets deflection mechanism and the direction so as to press the trailing end of the bundle of sheets (the side abutting the trailing end when the bundle of sheets are introduced).

The middle folding mechanism is provided at the nearly center of the saddle stitch binding processing tray G and includes a folding plate 74, folding rollers 81, and a conveying path H conveying bundles of sheets. Some of the numerals in FIG. 1 indicate as follows: the numeral 326 indicates a home position sensor for detecting the home position of the rear end tapping claw 251; the numeral 323 indicates a ejecting to middle folding detection sensor for detecting sheets folded in the middle; the numeral 321 indicates a bundle detection sensor for detecting the reach of bundles of sheets to the middle folding position; the numeral 322 indicates a movable rear-end reference fence home position sensor for detecting the home position of the movable rear-end reference fence 73.

After middle folding processing is performed on a single sheet or saddle stitch binding processing is performed on a bundle of a plurality of sheets, the sheet or the bundle of sheets are ejected on the saddle stitch binding stacking tray unit Z. The saddle stitch binding stacking tray unit will be described in detail later.

A saddle stitch binding operation is a publicly known technology as disclosed in Japanese Patent Application Laid-open No. 2006-143466, for example, thus the detailed description thereof is omitted.

Figure 7:
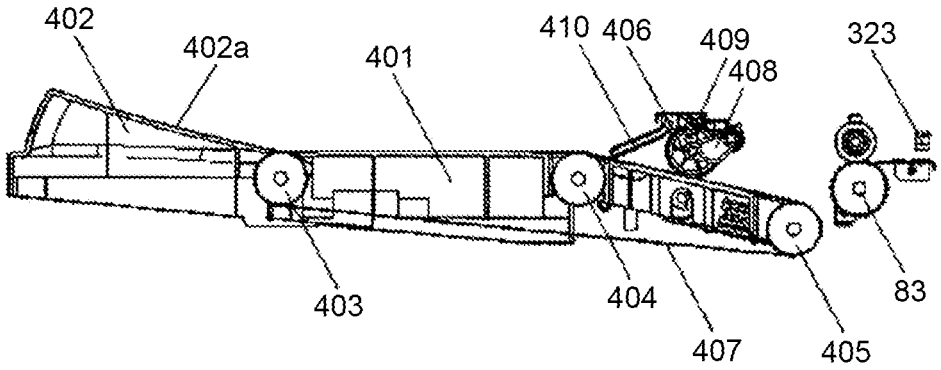
FIG. 7 is a cross-sectional view for illustrating the schematic structure of a saddle stitch binding stacking tray unit according to the embodiment.
Figure 8:
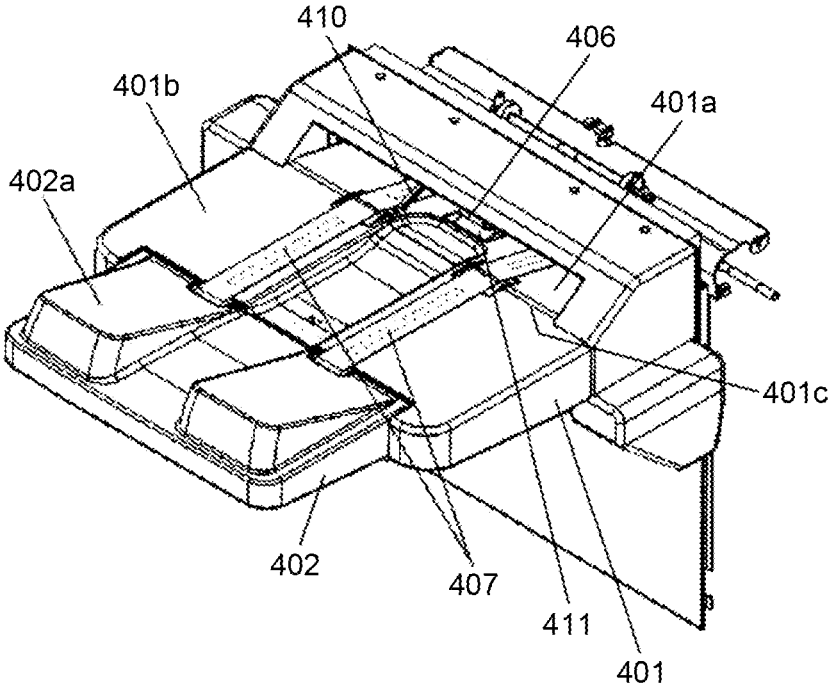
FIG. 8 is a perspective view of the saddle stitch binding stacking tray unit illustrated in FIG. 7 according to the embodiment.
Figure 9:
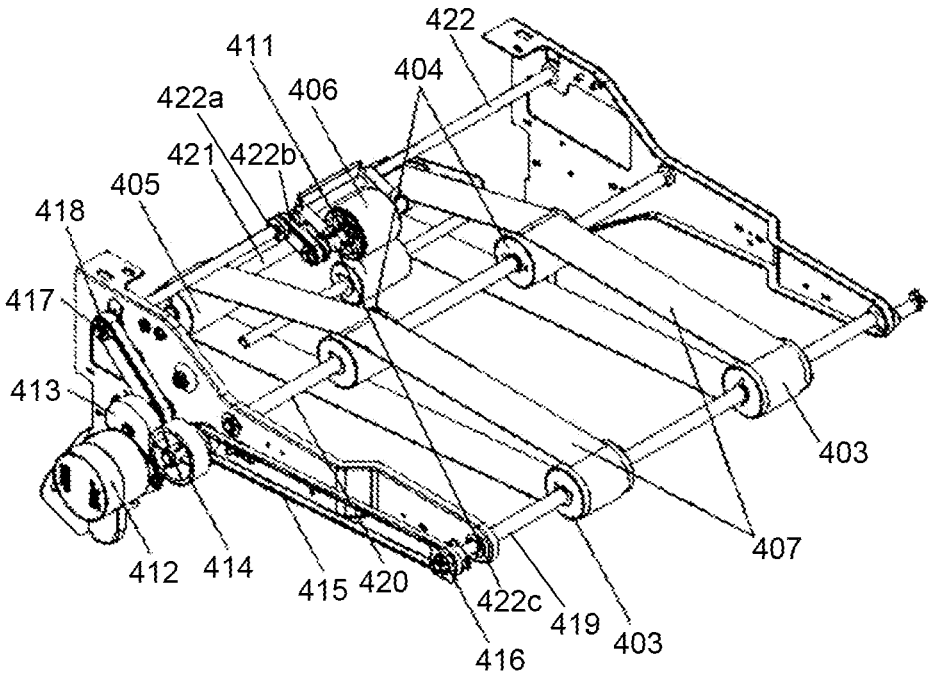
FIG. 9 is a perspective view of the inner structure of the saddle stitch binding stacking tray unit according to the embodiment.

FIG. 7 is a cross-sectional view for illustrating the schematic structure of the saddle stitch binding stacking tray unit. FIG. 8 is a perspective view of the saddle stitch binding stacking tray unit illustrated in FIG. 7. FIG. 9 is a perspective view of the inner structure of the saddle stitch binding stacking tray unit.

With reference to FIG. 7 and FIG. 8, as also illustrated in FIG. 1, the saddle stitch binding stacking tray unit Z includes a sheet stacking unit 401, a sheet stacking auxiliary unit 402, a conveyance driving roller 406, conveying belts 407, a conveying belt driving roller 403, and a conveying belt driven rollers 404 and 405.

The sheet stacking unit 401 functions as a first stacking unit and includes a sloped surface 401*a*, a nearly horizontal surface 401*b* provided along the sheet ejecting direction and a curved surface 401*c* provided between the sloped surface 401*a* and the nearly horizontal surface 401*b*. The sloped surface 401*a*, the curved surface 401*c*, and the nearly horizontal surface 401*b* constitute a continuous stacking surface (sheet stacking surface). The sloped surface 401*a* is sloped so that the sheet ejecting outlet side (the side of the ejecting roller 83) thereof is lowered. The length in the sheet ejecting direction of the nearly horizontal surface 401*b* is longer than the length in the sheet ejecting direction of the sloped surface 401*a*.

On the front surface of sheet stacking unit 401, conveying belts 407 as a sheet conveying unit are placed being supported by a conveying belt driving roller 403, the conveying belt driven rollers 404 and 405, along the stacking surface including the sloped surface 401*a*, the curved surface 401*c*, and the nearly horizontal surface 401*b*. It is preferred that a high friction material made of chloro-polyethylene, for example, is used for each of the conveying belts 407. The conveying belt driving roller 403, the conveying belt driven rollers 404 and 405 are rotatably supported by a driving shaft 419, and driven shafts 420 and 421 coaxially as illustrated in FIG. 9.

The endless conveying belt 407 is bridged across the conveying belt driving roller 403, and the conveying belt driven rollers 404 and 405, with predetermined tension, and driven to rotate by the driving force provided on the driving shaft 419. The width of the conveying belts 407 is approximately 40 mm. A pair of the conveying belts 407 are provided with the interval therebetween set so as to be in the range of the width of a B5-sized sheet with short edge feed (SEF), with which the sheet post-processing apparatus PD according to the embodiment can perform saddle stitch binding processing on a bundle of sheets. Two conveying belts 407 are bridged across the rollers 403, 404, and 405 in the embodiment, however, three or more belts or one belt with a larger width may be used. The rollers 403, 404, and 405 are provided depending on the number of conveying belts as appropriate.

On the sloped surface 401*a* of the sheet stacking unit 401, the conveyance driving roller 406 that comes in contact with the upper surface of the stacked bundle of sheets to provide it with conveying force, and conveyance driven roller 411 on the side facing the conveyance driving roller 406. The conveyance driving roller 406 and the conveyance driven roller 411 provide enough conveying force to the bundle of sheets for them to rise against the sloped surface 401*a* and to prevent them from slipping down the sloped surface 401*a*. It is preferred that a high friction material such as ethylene propylene rubber (EP-rubber) is used for the conveyance driving roller 406. Using such a material ensures that conveying force is provided to the bundle of sheets. This also applies to the conveyance driven roller 411.

The conveyance driving roller 406 is swingably supported by a stacking tray reception guide member 408 and provided with an elastic force toward the conveyance driven roller 411 by an elastic force provision member 409 such as a compressed spring or a coil spring. When the bundle of sheets are ejected from the ejecting roller 83, it is guided by the nips of the conveyance driving roller 406 and the conveyance driven roller 411. The conveying belt 407 also provides the bundle of sheets with conveying force.

As illustrated in FIG. 9, the conveying belt driving roller 403 and the conveyance driving roller 406 rotate in a different (forward and reverse) rotational direction, however, they have to rotate at the same speed about the surfaces of each of the rollers. The driving force is, therefore, transmitted from a common driving source (stacking motor) 412 to the rollers 403 and 406 through deceleration mechanism elements 413, 414, 415, 416, 417, to 418 including a gear, a timing pulley, and a timing belt. If the stacking motor 412 adopts a motor capable of detecting the rotation such as a stepping motor and a brushless direct current motor with an encoder, the function can be achieved with the simple structure without a separate sensor. The driving force transmitted from the driving source 412 to a conveying driving roller driving shaft 422 is further transmitted through timing pulleys 422*a* and timing belts 422*b* to a shaft 422*c*, which drives the conveyance driving roller 406.

In the present embodiment, the bundles of sheets are sequentially conveyed in a state in which they partially overlap with each other in the area including the sloped surface 401*a* and the curved surface 401*c*. This prevents the folded portion of the subsequent bundle of sheets from coming into the opened end portion, i.e., the trailing end of the preceding bundle of sheets. This operation will be described in detail.

The sheet stacking auxiliary unit 402 is provided on the downstream side in the sheet conveying direction of the sheet stacking unit 401 and includes a sloped surface (a sheet stacking auxiliary surface 402*a*), whose end portion on the downstream side in the sheet conveying direction is positioned higher than the nearly horizontal surface 401*b* of the sheet stacking unit 401. The sheet stacking auxiliary surface 402*a* functions to prevent the bundle of sheets from dropping down and to regulate the position of the leading bundle of sheets, when a large amount of the bundles of sheets are sequentially conveyed by the conveyance driving rollers 406 and the conveying belt 407.

Figure 10:
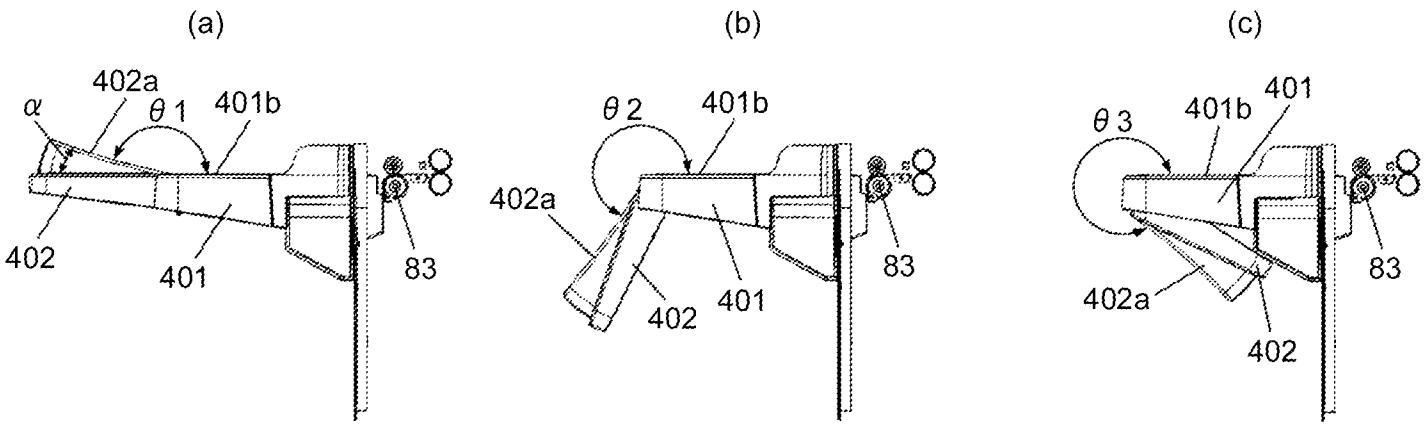
FIGS. 10(*a*) to 10(*c*) are views for illustrating rotational positions of a sheet stacking auxiliary unit according to different usages according to the embodiment.

Sometimes the sheet stacking auxiliary unit 402 is not used, therefore, the sheet stacking auxiliary unit 402 can be stored under the sheet stacking unit 401. FIGS. 10(*a*) to 10(*c*) are views for illustrating rotational positions (angles) of the sheet stacking auxiliary unit according to different usages of the sheet stacking auxiliary unit. FIG. 10(*a*) illustrates a sheet stacking position; FIG. 10(*b*) illustrates an ejecting position when a large amount of bundles of sheets are ejected without limitation; and FIG. 10(*c*) illustrates a retracted (stored) position. The sheet stacking auxiliary unit 402 can be stored from the sheet stacking position illustrated in FIG. 10(*a*) to the retracted position under the sheet stacking unit 401 illustrated in FIG. 10(*c*). As illustrated in FIG. 10(*b*), users can output a large amount of bundles of sheets and eject them without limitation.

Figure 11:
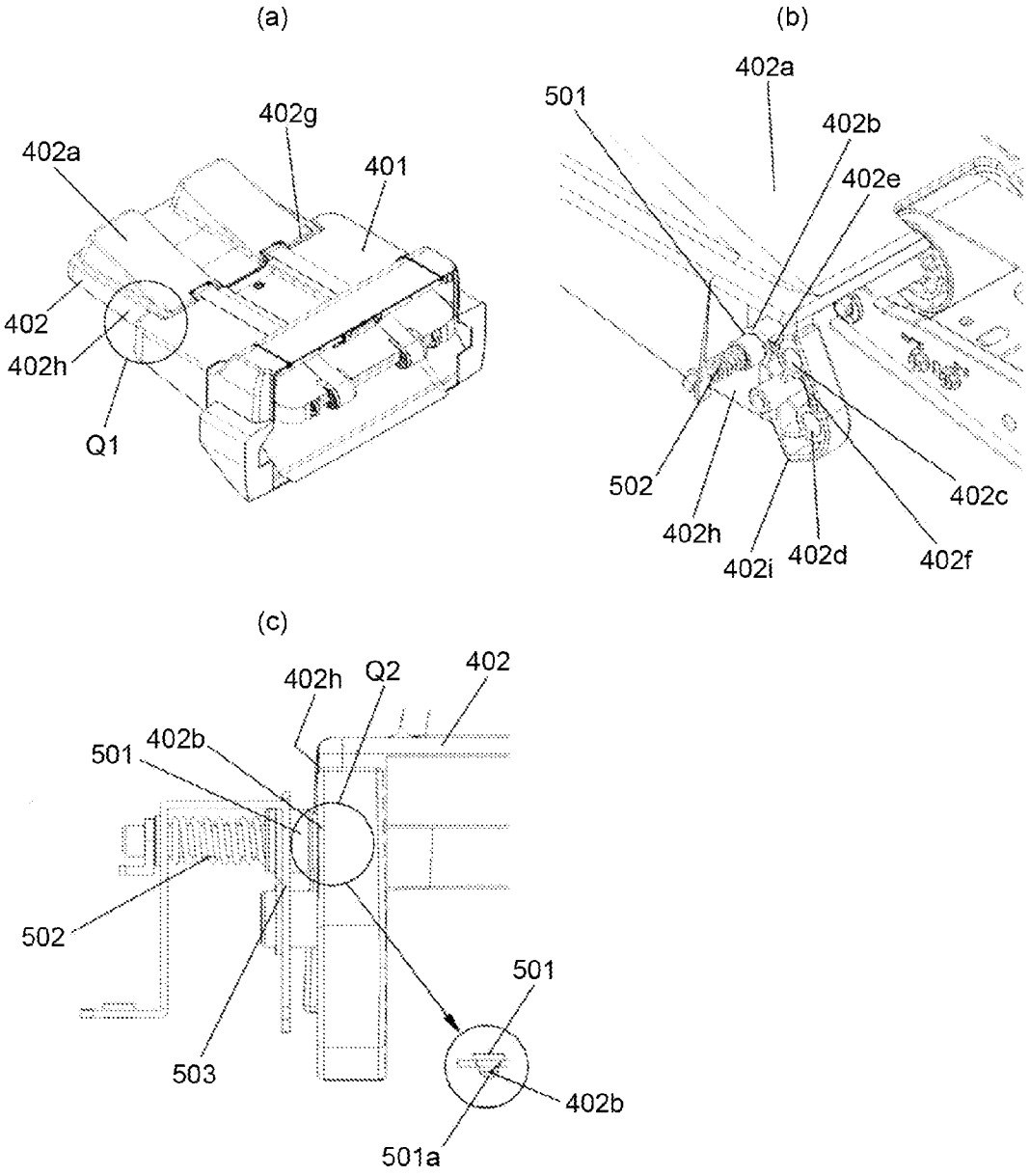
FIGS. 11(*a*) to 11(*c*) are views for explaining the installation structure of the sheet stacking auxiliary unit to a sheet stacking unit according to the embodiment.

FIGS. 11(*a*) to 11(*c*) are views for explaining the installation structure of the sheet stacking auxiliary unit to the sheet stacking unit. FIG. 11(*a*) is a perspective view of the sheet stacking auxiliary unit; FIG. 11(*b*) is a detailed perspective view of the part Q1 illustrated in FIG. 11(*a*); and FIG. 11(*c*) is an enlarged view of related portion where a retaining member and the sheet stacking auxiliary unit fit into each other (hereinafter, referred to as a "fitting").

FIG. 11(*a*) corresponds to a diagram FIG. 8 viewed from the upstream side in the sheet conveying direction. As illustrated in FIG. 11(*b*), a mounting portion 402*i* is formed on a side surface 402*h* of a base end side 402*g* of the sheet stacking auxiliary unit 402 illustrated in FIG. 11A. The mounting portion 402*i* includes a first to third fitting holes 402*b*, 402*c*, and 402*d* for installing the sheet stacking auxiliary unit 402 to the sheet stacking unit 401. A first guide groove 402*e* is provided between the first fitting hole 402*b* and the second fitting hole 402*c*, and a second guide groove 402*f* is provided between the second fitting hole 402*c* and the third fitting hole 402*d*.

On the sheet stacking unit 401, as illustrated in FIGS. 11(*b*) and 11(*c*), a retaining member 501 is provided having a hemispherical stopper at its leading end that fits into the first to third fitting holes 402*b*, 402*c*, and 402*d* of the sheet stacking auxiliary unit 402. The stopper 501*a* is always provided with an elastic force on the side surface of the sheet stacking auxiliary unit 402 by a compressed spring 502 so as to fit any one of the first to third fitting holes 402*b*, 402*c*, and 402*d*, or either the first guide groove 402*e* or the second guide groove 402*f*. This fitting state is illustrated in Q2 in FIG. 11(*c*).

The retaining member 501 is attached to the sheet stacking unit 401 with a mounting member 503 interposed that regulates movable directions of the retaining member 501, as illustrated in FIG. 11(*c*). "Stacking" means here loading and placing sheets, or sheets are loaded and placed, thus the "sheet stacking unit" means the portion where sheets are loaded and placed. The retaining member 501 is attached to the sheet stacking unit 401 by the mounting member 503. The stopper 501*a* fits any one of the first to third fitting holes 402*b*, 402*c*, and 402*d* depending on the rotational positions of the sheet stacking auxiliary surface 402*a* illustrated in FIGS. 10(*a*), 10(*b*), and 10(*c*) (θ1, θ2, and θ3 described later). When the rotational position of the sheet stacking auxiliary surface 402*a* is changed, the sheet stacking auxiliary unit 402 moves with the leading end portion of the stopper 501*a* fitted into the first guide groove 402*e* or the second guide groove 402*f*, while being guided by the corresponding groove. The sheet stacking auxiliary unit 402 is attached to the sheet stacking unit 401 by the first to third fitting holes 402*b*, 402*c*, and 402*d* and the retaining member 501 in a rotatable and movable manner in a predetermined range.

A pair of the stoppers 501*a* and pairs of the first to third fitting holes 402*b*, 402*c*, and 402*d* are provided on the surface sides of a base end sides 502*g* of the sheet stacking auxiliary unit 402 symmetrically on the respective positions, with the line parallel to the sheet conveying direction and passing through the center of the line perpendicular to the sheet conveying direction of the sheet stacking auxiliary unit 402 as the axis of symmetry.

The sheet stacking auxiliary unit 402 is installed to the sheet stacking unit 401 as follows: the mounting portion 402*i* is inserted from the leading end portion of the sheet stacking unit 401 into the both ends of the sheet stacking unit 401 so that the pair of the stoppers 501*a* of the retaining members 501 are inserted into the pair of the first fitting holes 402*b*. The stoppers 501*a* are attached to the mounting members 503 in a state of always being provided with an elastic force by the compressed springs 502 as described above, slidably in a predetermined range in the axial direction of the retaining member 501. This enables the stopper 501*a* to fit into any one of the first to third fitting holes 402*b*, 402*c*, and 402*d* elastically.

These operations will now be described in detail in associated with FIGS. 10(*a*) to 10(*c*). The sheet stacking auxiliary unit 402 is located at the position illustrated in FIG. 10(*a*) when the stopper 501*a* fits into the first fitting hole 402*b*, at the position illustrated in FIG. 10(*b*) when the stopper 501*a* fits into the second fitting hole 402*c*, and at the position illustrated in FIG. 10(*c*) when the stopper 501*a* fits into the third fitting hole 402*d*. The position when the stopper 501*a* fits into the first fitting hole 402*b* is the sheet stacking position, where the stopper 501*a* is deeply inserted into the first fitting hole 402*b* to maintain the fitting state at the position. The position when the stopper 501*a* fits into the second fitting hole 402*c* is the limitless ejecting position described in claims according to the present invention, where the stopper 501*a* is shallowly inserted into the second fitting hole 402*c* to maintain the fitting state at the position. The position when the stopper 501*a* fits into the third fitting hole 402*d* is the retracted position, where the stopper 501*a* is shallowly inserted into the third fitting hole 402*d* to maintain the fitting state at the position.

The depth of the fitting depends on the diameters of the first to third fitting holes 402*b*, 402*c*, and 402*d*. For example, the diameter of the first fitting hole 402*b* is set as the same diameter of the hemisphere of the stopper 501*a*, and the diameters of the second fitting hole 402*c* and the third fitting hole 402*d* are set to the length smaller than the hemisphere of the stopper 501*a*. The extent of reducing the diameter of the fitting hole depends on the required retention force.

To remove the sheet stacking auxiliary unit 402, with reference to FIG. 11C, the stopper 501*a* is slid outward, against the elastic force on the compressed spring 502. The hemispherical portion at the leading end portion of the stopper 501*a* is thus removed, whereby the sheet stacking auxiliary unit 402 is separated from the sheet stacking unit 401.

The installation structure of the sheet stacking auxiliary unit 402 to the sheet stacking unit 401 is not limited to the one illustrated in FIGS. 11(*a*) to 11(*c*) because various shapes can be adopted for the shape of the mounting portion 402*i* depending on the structure and the shape of the sheet stacking auxiliary unit 402 that is installed to the sheet stacking unit 401, as long as installation structure has a coupling structure with which the later-described operation can be performed.

In the example illustrated in FIGS. 11(*a*) to 11(*c*) a user manually rotates the sheet stacking auxiliary unit 402 to change the fitting state of the stopper 501*a* to the first to third fitting holes 402*b*, 402*c*, and 402*d*. This positional change may be, however, achieved by an operation input from an operation panel PR1 of an image forming apparatus PR, which will be described later, using a motor and a deceleration mechanism, for example (refer to FIG. 16). In this example, a drive instruction signal is output from the image forming apparatus PR to a CPU_PD1 of the sheet post-processing apparatus PD, which drives the motor according to the received drive instruction signal and sets the rotational position of the sheet stacking auxiliary unit 402.

Figure 12:
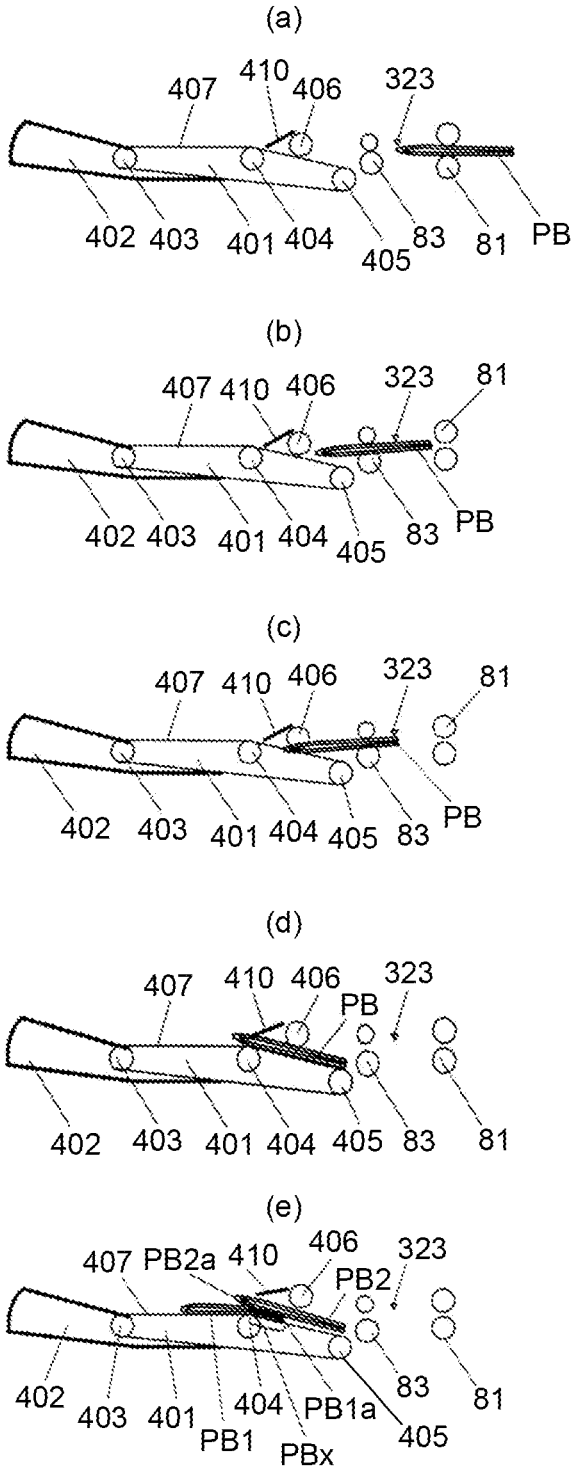
FIGS. 12(*a*) to 12(*e*) are views for explaining operations when the bundles of sheets are stacked on the saddle stitch binding stacking tray according to the embodiment.

FIGS. 12(*a*) to 12(*e*) are views for explaining operations when the bundles of sheets are stacked on the saddle stitch binding stacking tray. The sheet stacking auxiliary unit of the saddle stitch binding stacking tray unit Z is controlled by the CPU_PD1 described later.

When the sheets or the bundles of sheets (the bundles of sheets are used as an example hereinafter) are ejected to the saddle stitch binding stacking tray Z, middle folding processing is firstly performed on a bundle of sheets PB in the saddle stitch binding and middle folding processing tray G of the sheet post-processing apparatus PD. The bundle of sheets PB are conveyed as they are, then reach an ejecting after middle folding detection sensor 323 (FIG. 12(*a*)). After middle folding and saddle stitch binding processing, additional folding processing (not illustrated) is performed in general to reduce the height of the bundle of sheets. After the bundle of sheets PB passes through the middle folding rollers 81, therefore, the bundle of sheets PB temporally stops before reaching the ejecting roller 83, and before reaching the ejecting after middle folding detection sensor 323 or after reaching the ejecting after middle folding detection sensor 323.

The ejecting after middle folding detection sensor 323 includes a reflective photo sensor arranged between the middle folding rollers 81 and the ejecting roller 83, which irradiates the conveying path for the bundle of sheets PB with light. By detecting the reflected light, the ejecting after middle folding detection sensor 323 determines the presence of the leading end and the trailing end of the bundle of sheets PB. The ejecting after middle folding detection sensor 323 has a function to determine the timing of the middle folding processing and a function to detect an error, when sheet jamming occurs due to some reason, for example. Specifically, in determination of the timing of the middle folding processing, the ejecting after middle folding detection sensor 323 is used for determining the timing of driving the rollers during the additional folding processing and for determining the timing of returning of the bundle of sheets PB.

Once the middle folding processing has been successfully performed and the bundle of sheets PB are ejected, the processing is proceeded to middle folding and saddle stitch binding stacking control. In this control, a full state detection feeler 410 and a feeler position sensor (full state detection sensor) (not illustrated) firstly detect and determine whether the saddle stitch binding stacking tray Z is filled. The feeler position sensor is a publicly known sensor adopting a feeler. The feeler position sensor optically detects the position of the end opposing the side of contacting sheets of the feeler, thereby determining whether the saddle stitch binding stacking tray Z is full from the detected position. According to the position of the full state detection feeler 410, if it is determined that the bundles of sheets PB are stacked to the maximum amount on the sheet stacking unit 401 of the saddle stitch binding stacking tray Z, a signal is sent to the CPU_PD1 of the sheet post-processing apparatus PD so that the processing is proceeded to filled processing in which no bundle of sheets are accepted by the saddle stitch binding stacking tray Z. Full state detection described above adopts the feeler position sensor, however, other sensors may be used. A long-range reflective sensor may be used, for example, for detecting the standing leading end of the bundles of sheets PB stacked on the sheet stacking unit 401 of the saddle stitch binding stacking tray Z.

When the saddle stitch binding stacking tray Z can receive the bundle of sheets PB, that is to say, if it is determined that the bundles of sheets PB are not stacked to the maximum amount on the sheet stacking unit 401 of the saddle stitch binding stacking tray Z, an instruction signal is sent to the stacking motor 412, before a bundle of sheets PB being conveyed from the saddle stitch binding unit reaches the conveyance driving roller 406, whereby the conveying belt 407 and the conveyance driving roller 406 are started to operate (FIG. 12(*b*)).

After that, the bundle of sheets PB are conveyed by the conveyance driving roller 406 (FIG. 12(*c*)) so as to pass through the ejecting roller 83, an instruction signal is sent to the stacking motor 412, whereby the conveying belt 407 and the conveyance driving roller 406 are stopped to operate (FIG. 12(*d*)).

FIG. 12(*e*) is a schematic view illustrating that the subsequent (second) bundle of sheets PB are sequentially conveyed and then stopped. A subsequent bundle of sheets PB2 is conveyed to overlap with the preceding bundle of sheets PB1 with a predetermined overlapping amount of area PBx. The presence of the overlapping amount of area can prevent the folded portion PB2*a*, i.e., the leading end portion of the subsequent bundle of sheets PB2 from coming into the opened end portion PB1*a*, i.e., the trailing end of the preceding bundle of sheets PB1.

This operation is repeated to convey the bundles of sheets sequentially. By performing the processing described above, bundles of sheets PB are conveyed and stopped repeatedly, whereby bundles of sheets PB can be sequentially conveyed and stacked while the trailing end of the preceding bundle of sheets PB overlaps with the leading end of the subsequent bundle of sheets PB with a predetermined overlapping amount of area PBx.

Figure 13:
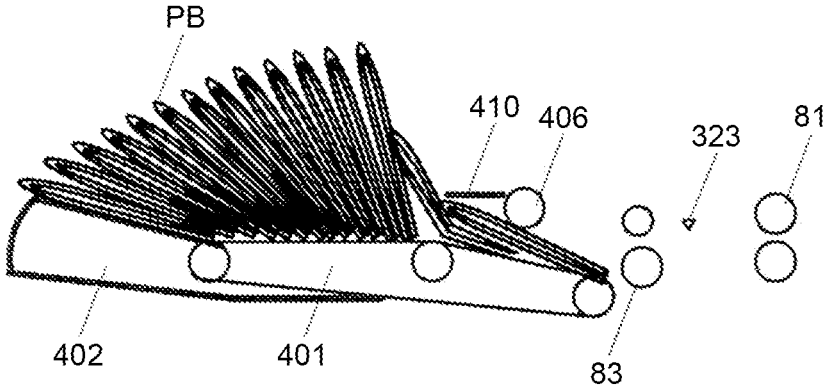
FIG. 13 is a schematic view of the state of the bundles of sheets on the saddle stitch binding stacking tray when a full detection sensor detects that the bundles of sheets are stacked to the maximum amount according to the embodiment.

FIG. 13 is a schematic view of the state of the bundles of sheets on the saddle stitch binding stacking tray when a feeler position sensor detects that the bundles of sheets are stacked to the maximum amount. When the bundle of sheets PB that is subsequently conveyed reach the sheet stacking auxiliary surface 402*a* of the sheet stacking auxiliary unit 402, the bundle of sheets PB are no more conveyed so as not to be dropped down and to regulate the position of the most preceding bundle of sheets PB1. As the subsequent bundles of sheets PB2 to PBn (n: positive integral numbers) are sequentially conveyed, they overlaps with the most preceding bundle of sheets PB1 contacting a sheet stacking auxiliary surface 402*a*. The bundle of sheets PB on which the middle folding processing and the saddle stitch binding processing are performed has a swell at the folded portion. As the opened end portion of the bundle of sheets PB is closed, the bundles of sheets PB gradually rise up to the point where the feeler position sensor detects a full state. When a series of binding operations is completed, the middle folding and saddle stitch binding stacking control is ended. If a full state has been detected, the processing is proceeded to the filled processing.

Figure 14:
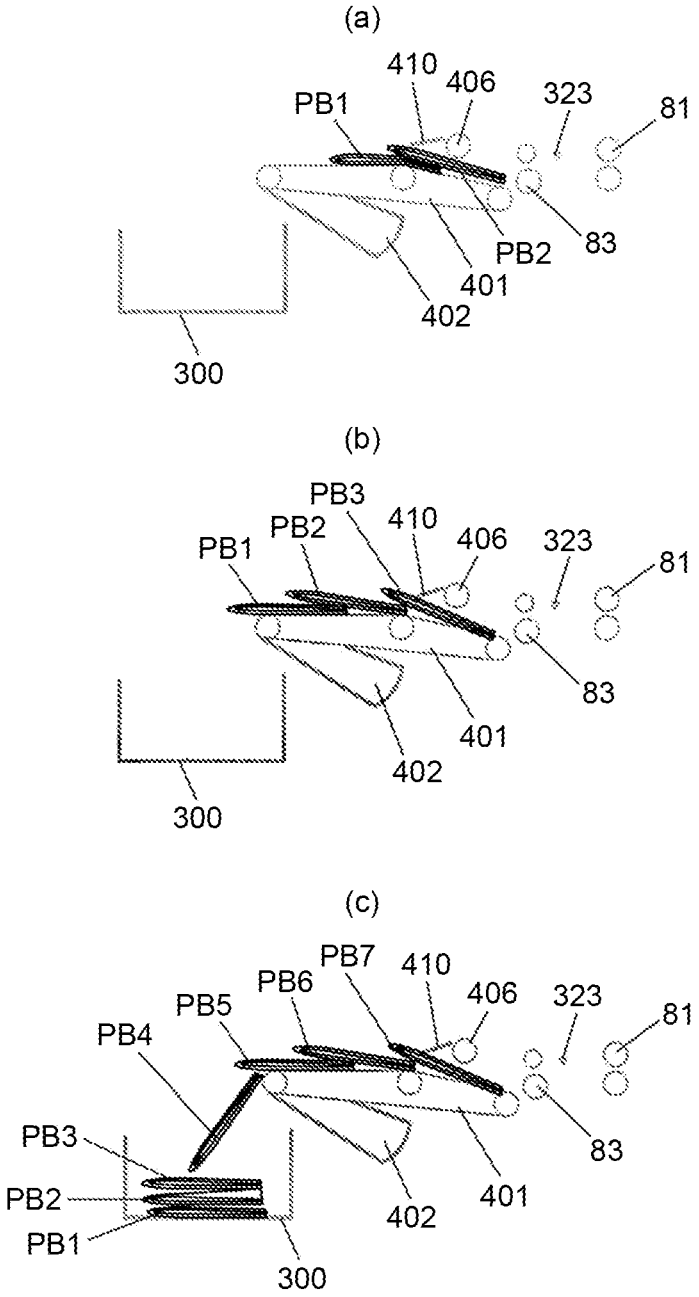
FIGS. 14(*a*) to 14(*c*) are schematic views for explaining operations of the saddle stitch binding stacking tray ejecting the bundles of sheets without limitation according to the embodiment.

FIGS. 14(*a*) to 14(*c*) are schematic views for explaining operations of the saddle stitch binding stacking tray that ejects the bundles of sheets without limitation.

In the same way when the sheet stacking auxiliary unit 402 is used as illustrated in FIGS. 12A to 12E, ejecting the bundles of sheets without limitation is also controlled by the CPU_PD1 of the sheet post-processing apparatus PD. The sheet stacking auxiliary unit 402, however, no more exists in FIG. 14 because it has been stored under the sheet stacking unit 401 as illustrated in FIG. 10(*c*). No member for stacking the sheets exists on the downstream side in the sheet conveying direction of the sheet stacking unit 401. As illustrated in FIG. 14, instead of the sheet stacking auxiliary unit 402, a storage box 300 is provided, with the upper side opened, below the most downstream side in the sheet conveying direction of the conveying belt driving roller 403. The storage box 300 stores and stacks therein the bundles of sheets PB.

Figure 15:
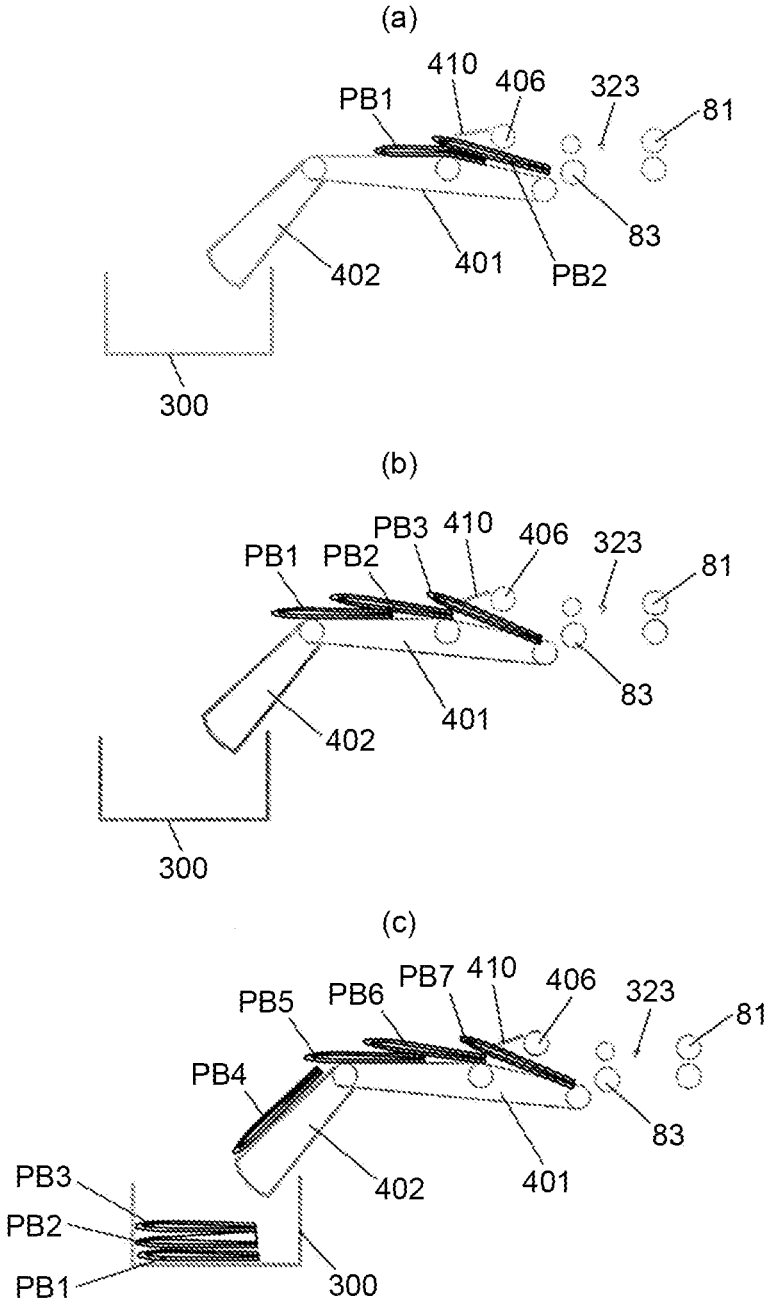
FIGS. 15(*a*) to 15(*c*) are views for explaining operations of ejecting the bundles of sheets without limitation when the sheet stacking auxiliary surface of the saddle stitch binding stacking tray unit is tilted obliquely downward in the sheet conveying direction so as to function as a guide according to the embodiment.

The subsequent bundles of sheets PB are sequentially conveyed by the conveying belt 407, from the state illustrated in FIG. 12(*e*), while the leading end portion of the subsequent bundle of sheets PB2 overlaps with the trailing end of the preceding bundle of sheets PB1 with the overlapping amount of area PBx as illustrated in FIGS. 14(*a*) and 14(*b*). As illustrated in FIG. 15(*b*), the bundles of sheets PB are not regulated by the sheet stacking auxiliary surface 402*a*, therefore, as the subsequent bundles of sheets PB are sequentially conveyed, the preceding bundles of sheets PB drop down and are sequentially stored in the storage box 300 as illustrated in FIG. 15(*c*).

FIG. 15(*c*) is a view of the state of the bundles of sheets PB sequentially conveyed and dropped down in the storage box 300. As illustrated in FIG. 15(*c*), the bundles of sheets PB1, PB2, and PB3 have already been stored in the storage box 300 stacked in this order. From this state, the bundle of sheets PB4 by the fourth job is dropped down onto the stored bundle of sheets PB3. This operation is repeated sequentially. The full detection is not performed in this example, therefore, the bundles of sheets can be stacked without limitation until a series of jobs is completed, by replacing the storage box 300 with another storage box. This continues image forming operations of the image forming apparatus PR without interruption. FIG. 15C illustrates the operations for conveying and stacking the bundles of sheets PB1 to PB7.

When the sheet stacking auxiliary unit 402 is stored under the sheet stacking unit 401 as illustrated in FIG. 14, however, the following issues occur. The balance of the weight of the bundle of sheets PB itself varies in the sheet conveying direction due to the position of staple binding. In addition, no guiding member is provided, and the posture of the bundle of sheets PB cannot be controlled. As a result, some of the bundles of sheets PB that have been conveyed by the conveying belt 407 and dropped down may be stacked with the stapled position thereof facing the direction opposing the sheet conveying direction. Alternatively, they may be stacked with the end portion of the bundles of sheets remaining open.

FIG. 15 is a view for explaining operations when the bundles of sheets are ejected without limitation while the sheet stacking auxiliary surface of the saddle stitch binding stacking tray unit is tilted so that the downstream side in the sheet conveying direction is lowered so as to function as a guide for the bundles of sheets. In the example illustrated in FIGS. 15(*a*) to 15(*c*), the sheet stacking auxiliary unit 402 is tilted in the direction of the storage box 300 for the ejecting operation. This differs from the example illustrated in FIG. 10(*b*) in which the sheet stacking auxiliary unit 402 is stored under the sheet stacking unit 401.

The ejecting operations illustrated in FIGS. 15(*a*) to 15(*c*) correspond to FIGS. 14(*a*) to 14(*c*). FIGS. 15(*a*) to 15(*c*) illustrate that the sheet stacking auxiliary surface 402*a* is located in the position tilted downward against the horizontal line of the sheet stacking surface, for ejecting the bundles of sheets PB. FIGS. 15(*a*) and 15(*b*) illustrate that, in the same manner as illustrated in FIGS. 14(*a*) and 14(*b*), when the bundles of sheets PB are sequentially conveyed by the conveying belt 407, the bundles of sheets PB drop down into the storage box 300 along the tilted sheet stacking auxiliary surface 402*a* of the sheet stacking auxiliary unit 402. The sheet stacking auxiliary surface 402*a* regulates the position where the bundles of sheets PB drop down. This enables the bundles of sheets PB to be sequentially stacked with the bound sides of the bundles of sheets PB aligned along one of the wall surfaces of the storage box 300 as illustrated in FIG. 15(*c*). As a result, a large amount of the bundles of sheets PB can be stored in the storage box 300 in order. In addition, image forming can be performed without limitation and bundles of sheets can be handled efficiently after sheet-processing.

As described above, the sheet stacking auxiliary unit 402 is rotatably installed to the sheet stacking unit 401 by the mounting portion 402*i* and the retaining member 501. The stopper 501*a* of the retaining member 501 is provided with an elastic force inward by the compressed spring 502. Friction force acts on between the stopper 501*a* and the fitting holes 402*b*, 402*c*, or 402*d* into which the stopper 501*a* fits. The stopper 501*a* is provided with elastic force by the compressed spring 502, therefore, the sheet stacking auxiliary unit 402 is maintained at the rotational position determined by a user's operation. That is to say, a user rotates and moves the sheet stacking auxiliary unit 402, whereby the sheet stacking auxiliary unit 402 is maintained at any intended position between the positions illustrated in FIG. 10(*a*) and the position illustrated in FIG. 10(*c*). The angle of the sheet stacking auxiliary unit 402 illustrated in FIG. 15(*c*), therefore, can be set by a user as intended.

FIG. 10(*a*) illustrates the sheet stacking position of the sheet stacking auxiliary surface 402*a*. The sheet stacking auxiliary surface 402*a* of the sheet stacking auxiliary unit 402 forms an angle θ1 of about 180 degrees (180°−α: α is the angle of slope of sheet stacking auxiliary surface 402*a* against the upper surface of the sheet stacking auxiliary unit 402) against the nearly horizontal surface 401*b* of the sheet stacking unit 401. FIG. 10(*b*) illustrates the limitless ejecting position of the sheet stacking auxiliary surface 402*a*. The sheet stacking auxiliary surface 402*a* forms an angle θ2 of about 225 degrees (2250°−α) against the nearly horizontal surface 401*b* of the sheet stacking unit 401. FIG. 10(*c*) illustrates the retracted position of the sheet stacking auxiliary surface 402*a*. The sheet stacking auxiliary surface 402*a* forms an angle θ3 of about 270 degrees (270°−α) against the nearly horizontal surface 401*b* of the sheet stacking unit 401. The position of the sheet stacking auxiliary unit 402 for limitless ejecting may be set as intended between the range of (180°−α) and (270°−α). In the present embodiment, the angle of slope α equals to the angle of slope of sheet stacking auxiliary surface 402*a* against the nearly horizontal surface 401*b* because the upper surface of the sheet stacking auxiliary unit 402 is set on the same plane of the nearly horizontal surface 401*b*.

The range of the rotational position of the sheet stacking auxiliary unit 402 is set to be as follows:

$$\theta 1<\theta<\theta 3$$

or $$180°-\alpha<\theta<270°-\alpha.$$

In the present embodiment, the sheet stacking auxiliary unit 402 is set manually by a user; however, it may be set to an intended angle by a driving mechanism including a motor, which is instructed by a user through a later-described operation panel. In this example, if the driving mechanism (deceleration mechanism) has a function to maintain positions, the sheet stacking auxiliary unit 402 may be stopped at an intended angle according to the drive amount (rotational amount) of the motor and maintained at the angle, without using the first to three fitting holes 402*b* to 402*d*.

In the present embodiment, the bundle of sheets PB are used in the description, which has been formed by stapling a plurality or sheets and folding them in the middle. A single sheet folded in the middle may also be used in the same manner.

As described above, in the sheet post-processing apparatus PD, by moving the angle of the sheet stacking auxiliary surface 402*a* of the sheet stacking unit 401 lower than the horizontal line, the bundles of sheets PB drop down along the slope of the leading end portion of the tray in a stable state. This makes the bundles of sheets dropped down from the end of the conveying portion of the saddle stitch binding stacking tray and stacked in a preferred state.

Figure 16:
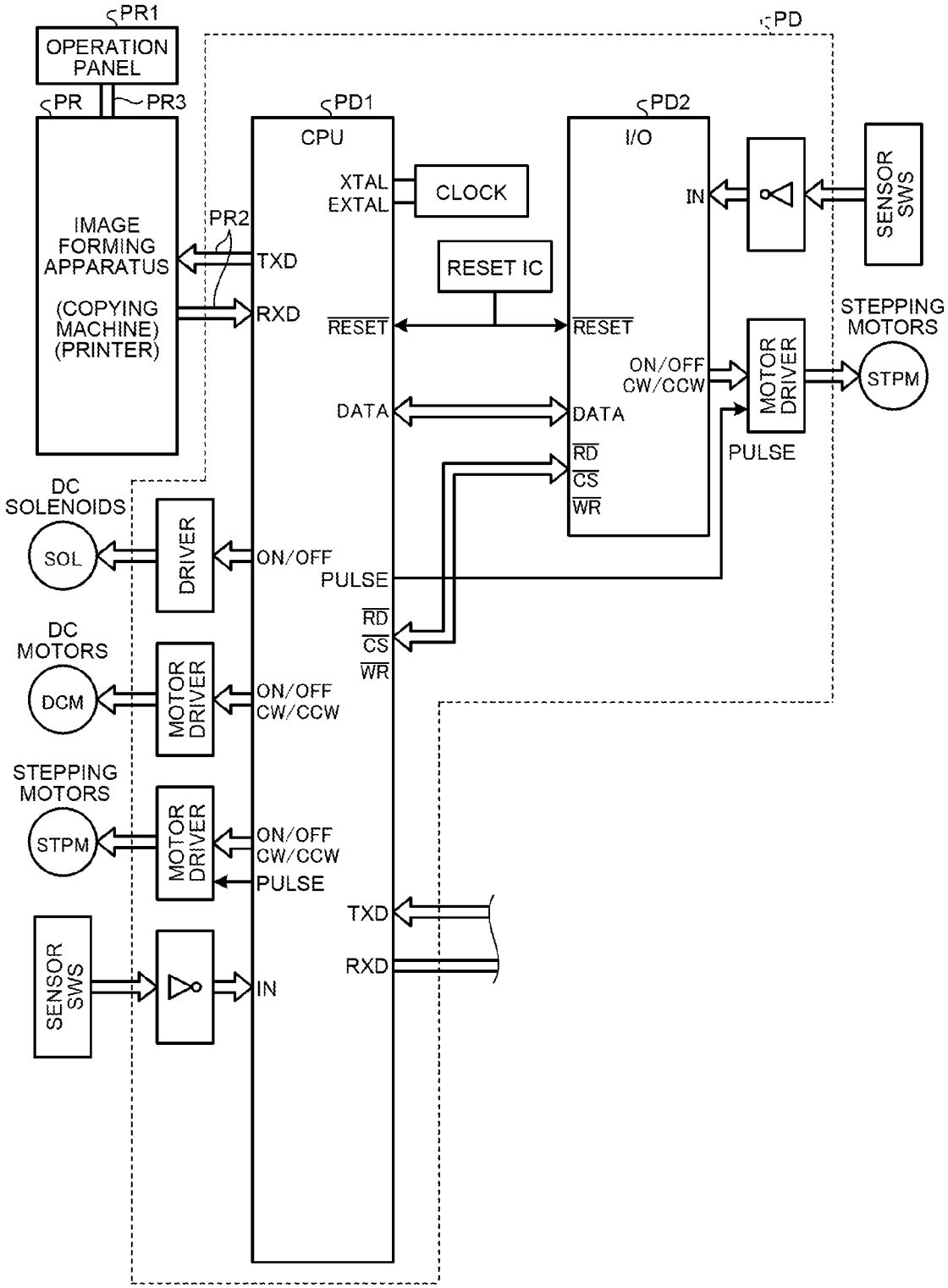
FIG. 16 is a block diagram of the control structure of an image forming system including a sheet post-processing apparatus PD and an image forming apparatus PR according to the embodiment.

The control of the sheet post-processing apparatus PD of the image forming system and operations of the components described above are performed in a control circuit of the sheet post-processing apparatus PD. FIG. 16 is a block diagram of the control structure of an image forming system including the sheet post-processing apparatus PD and the image forming apparatus PR.

As illustrated in FIG. 16, the sheet post-processing apparatus PD has a control circuit with a microcomputer including the CPU_PD1 and an input and output interface. Signals are input through a communication interface PR2 from the CPU of the image forming apparatus PR, the switches of the operation panel PR1, and the sensors (not illustrated) to the CPU_PD1 that performs predetermined control according to the input signal. The CPU_PD1 performs drive control on a solenoid and a motor, through a driver or a motor driver, thereby obtaining information of the sensors in the apparatus from another interface.

The CPU_PD1 performs drive control on a motor through the input and output interface PD2 according to the subjects to be controlled or the sensors, thereby obtaining information of the sensors from the related sensors. The CPU_PD1 loads a computer program code stored in a ROM (not illustrated) to a RAM (not illustrated) and uses the RAM as a working area or a data buffer, whereby the control described above is performed according to the computer program defined in the computer program code.

The control of the sheet post-processing apparatus PD illustrated in FIG. 16 is performed according to an instruction or information from the CPU of the image forming apparatus PR. Operating instructions by a user are input through the operation panel PR1 of the image forming apparatus PR, and the image forming apparatus PR and the operation panel PR1 are coupled to each other through a communication interface PR3. Operating signals through the operation panel PR1 are, therefore, sent from the image forming apparatus PR to the sheet post-processing apparatus PD, and a user or an operator is notified of a processing state or a function of the sheet post-processing apparatus PD through the operation panel PR1.

As described above, the embodiment according to the present invention can provide the advantageous effect described below.

1) In the sheet post-processing apparatus PD that includes the ejecting roller 83 that ejects bundles of sheets PB and the sheet stacking unit 401 that stacks the bundles of sheets ejected by the ejecting roller 83 in a state in which the bundles of sheets overlap with each other, the leading end portion of the sheet stacking unit 401 on the downstream side in the sheet conveying direction is downward rotatably provided on the downstream side in the sheet conveying direction. The bundles of sheets are thus dropped down from the leading end portion so as to be dropped down in a stable state along the slope of the sheet stacking unit 401. As a result, a user does not have to align the bundles of sheets dropped down to be stored and stacked in the storage box. The bundles of sheets PB are not open after being dropped down, thus the bundles of sheets PB are not damaged.

2) The bundles of sheets PB are stacked on the sheet stacking unit 401 in a state of partially overlapping with each other. The bundles of sheets PB are dropped down from the sheet stacking auxiliary unit 402 that is rotatably provided on the leading end portion of the sheet stacking unit 401 and tilted downward. As a result, the bundles of sheets PB can be dropped down in a stable state along the slope of the sheet stacking unit 401 below the leading end portion of the sheet stacking unit 401 with a simple structure, whereby the advantageous effect described in 1) can be provided.

3) The range of the rotational position of the sheet stacking auxiliary unit 402 is set to be:

$$180°-\alpha<\theta<270°-\alpha$$

where the angle formed by the sheet stacking surface 402*a* of the sheet stacking auxiliary unit 402 against the conveying surface of the sheet stacking unit 401 is θ and the angle of slope of the sheet stacking auxiliary surface 402*a* against the upper surface of the sheet stacking auxiliary unit 402 is α.

As a result, the rotational position of the sheet stacking auxiliary unit 402 can be set to a position to stack the sheet (sheet stacking position), a position to eject the bundles of sheets without limitation (limitless ejecting position), and a position to retract the sheet stacking auxiliary unit 402 under the sheet stacking unit 401 (retracted position) within the range.

4) The rotational position of the sheet stacking auxiliary unit 402 is set to the three positions: the sheet stacking position (the position represented with the angle θ1), the limitless ejecting position (the position represented with the angle θ2), and the retracted position (the position represented with the angle θ3). As a result, the sheet stacking auxiliary unit 402 can be rotated and moved to any one of the three positions described above according to the ejecting mode, ejected state, or stacked state of bundles of sheets, whereby an intended operation can be achieved.

5) The mounting portion 402*i* is provided on the side surface 402*h* of the sheet stacking auxiliary unit 402. On the mounting portion 402*i*, the first to third fitting holes 402*b*, 402*c*, and 402*d* that regulate the rotational positions of the sheet stacking auxiliary unit 402, the first guide groove 402*e* and the second guide groove 402*f* that link the fitting holes 402*b*, 402*c*, and 402*d* are provided. On the sheet stacking unit 401 the retaining member 501 has a hemispherical stopper 501*a* at its leading end that fits into the first to third fitting holes 402*b*, 402*c*, and 402*d*, and moves along the guide grooves 402*e* and 402*f*. Therefore, by selecting the fitting positions between the hemispherical stopper 501*a* and the fitting holes, a user can readily set the rotational position of the sheet stacking auxiliary unit 402 to the sheet stacking position, the limitless ejecting position, and the retracted position.

6) When the sheet stacking auxiliary unit 402 is at the sheet stacking position, the stopper 501*a* fits into the first fitting hole 402*b* deeply. When the sheet stacking auxiliary unit 402 is at the limitless ejecting position, the stopper 501*a* fits into the second fitting hole 402*c* shallowly. When the sheet stacking auxiliary unit 402 is at the retracted position, the stopper 501*a* fits into the third fitting hole 402*d* shallowly. Therefore, the retaining force can be set according to the state of the load on the sheet stacking auxiliary unit 402. The operating force to move the sheet stacking auxiliary unit 402 to the above-described positions can also be set.

7) When the driving source and the driving mechanism that rotate the sheet stacking auxiliary unit 402 and move it, the rotational position of the sheet stacking auxiliary unit 402 can be set to the sheet stacking position, the limitless ejecting position, and the retracted position using driving force of the driving source, by driving a motor, for example, rather than using a user's operating force.

8) When the driving force of the driving source is used, the rotational position of the sheet stacking auxiliary unit 402 can be set by the operation input through the operation panel PR1 of the image forming apparatus PR, for example, to which the sheet processing apparatus is coupled. Therefore, a user not familiar with the operation of the apparatus can surely set the rotational position.

9) The sheet stacking unit 401 further includes the folding plate 74 and the folding rollers 81 that fold the bundle of sheets. The sheet stacking unit 401 stacks the bundle of sheets PB that has been folded by the folding plate 74 and the folding rollers 81. Therefore, when dropping down the bundles of sheets PB and storing them in the storage box, a user does not have to align the bundles of sheets PB. The bundles of sheets PB do not open after being dropped down, thus the dropped bundles of sheets PB are not damaged.

The respective components described in the scope of claims correspond to the embodiment of the present invention as follows. The sheet corresponds to the bundle of sheets PB; an ejecting unit corresponds to the ejecting roller 83; the sheet stacking unit corresponds to the sheet stacking unit 401; the sheet processing apparatus corresponds to the sheet post-processing apparatus PD; the leading end portion corresponds to the sheet stacking auxiliary unit 402; the first stacking unit corresponds to the sheet stacking unit 401; a second stacking unit corresponds to the sheet stacking auxiliary unit 402; the stacking and conveying surface corresponds to the nearly horizontal surface 401*b*; the stacking surface corresponds to the sheet stacking surface 402*a*; the sheet stacking position, the ejecting position and the retracted position correspond to the rotational position of represented with the angles θ1, θ2, and θ3 illustrated in FIGS. 10(*a*) to 10(*c*); a plurality of holes correspond to the first to third fitting holes 402*b*, 402*c*, and 402*d*; the grooves correspond to the first guide groove 402*e* and the second guide groove 402*f*; the retaining member corresponds to the numeral 501; the hemispherical leading end corresponds to the stopper 501*a*; a folding unit corresponds to the folding plate 74 and the folding rollers 81; the image forming system corresponds to the system including the image forming apparatus PR and the sheet post-processing apparatus PD.

According to an aspect of the present invention, a user does not have to manually align the sheet or the bundles of sheets dropped down from the sheet stacking unit and stacked, and the dropped sheet or bundles of sheets are not damaged.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

an ejecting unit configured to eject a sheet or a bundle of sheets;

a sheet stacking unit configured to stack the sheet or the bundle of sheets ejected by the ejecting unit; and a sheet conveying unit on a front surface of the sheet stacking unit, wherein the leading end portion of the sheet stacking unit on the downstream side in the sheet conveying direction is rotatable downward and capable of dropping down the sheet or the bundle of sheets stacked on the sheet stacking unit from the leading end portion of the sheet stacking unit, and the sheet stacking unit includes a sheet stacking auxiliary surface whose end portion on the downstream side in the sheet conveying direction is positioned higher than a horizontal surface of the sheet stacking unit.

2. The sheet processing apparatus according to claim 1, wherein the sheet stacking unit further comprises a first stacking unit and a second stacking unit configured to be rotatably provided on the leading end side of the first stacking unit.

3. The sheet processing apparatus according to claim 2, wherein the range of the rotational position of the second stacking unit is set to be:

$$180°-\alpha<\theta<270°-\alpha$$

where the angle formed by the stacking surface of the second stacking unit against the stacking and conveying surface of the first stacking unit is θ and the angle of slope of the stacking surface against the stacking and conveying surface is α.

4. The sheet processing apparatus according to claim 2, wherein the rotational position of the second stacking unit is set to three positions: a sheet stacking position, an ejecting position, and a retracted position.

5. The sheet processing apparatus according to claim 4, wherein the second stacking unit has a plurality of holes that regulate the rotational position of the second stacking unit and a plurality of grooves that link the holes, and the first stacking unit comprises a retaining member that has a hemispherical leading end that fits into the holes and moves along the grooves.

6. The sheet processing apparatus according to claim 5, wherein the retaining member fits into the holes deeply when the rotational position is the sheet stacking position, and the retaining member fits into the holes shallowly when the rotational position is the ejecting position or the retracted position.

7. The sheet processing apparatus according to claim 2, further comprising a driving source and a driving mechanism configured to rotate the second stacking unit.

8. The sheet processing apparatus according to claim 7, wherein the second stacking unit is stopped at the rotational position that is set according to a control signal input into the driving source.

9. The sheet processing apparatus according to claim 1, further comprising:

a folding unit configured to fold the sheet or the bundle of sheets, wherein the sheet stacking unit stacks the sheet or the bundle of sheets folded by the folding unit.

10. The sheet processing apparatus according to claim 1, wherein the sheet stacking unit is positioned outside of an image forming system.

11. The sheet processing apparatus according to claim 2, wherein the first stacking unit includes a sloped surface, a horizontal surface provided along the sheet ejecting direction, and a curved surface provided between the sloped surface and the horizontal surface.

12. The sheet processing apparatus according to claim 11, wherein the sloped surface, the horizontal surface, and the curved surface constitute a continuous stacking surface.

13. The sheet processing apparatus according to claim 1, further comprising a plurality of conveying belt driving rollers, wherein the plurality of conveying belt driving rollers support the sheet conveying unit.

14. The sheet processing apparatus according to claim 13, wherein the sheet conveying unit is bridged across the plurality of conveying belt driving rollers with a set tension, and driven to rotate by a driving force provided on a driving shaft.

15. An image forming system comprising a sheet processing apparatus, wherein the sheet processing apparatus comprises:

an ejecting unit configured to eject a sheet or a bundle of sheets;

a sheet stacking unit configured to stack the sheet or the bundle of sheets ejected by the ejecting unit; and a sheet conveying unit on a front surface of the sheet stacking unit, wherein the leading end portion of the sheet stacking unit on the downstream side in the sheet conveying direction is rotatable downward and capable of dropping down the sheet or the bundle of sheets stacked on the sheet stacking unit from the leading end portion of the sheet stacking unit, and the sheet stacking unit includes a sheet stacking auxiliary surface whose end portion on the downstream side in the sheet conveying direction is positioned higher than a horizontal surface of the sheet stacking unit.

16. A sheet processing apparatus comprising:

an ejecting unit configured to eject a sheet or a bundle of sheets; and a sheet stacking unit configured to stack the sheet or the bundle of sheets ejected by the ejecting unit, wherein the sheet stacking unit is positioned outside of an image forming system, the stacking unit includes a sloped surface, a horizontal surface provided along the sheet ejecting direction, and a curved surface provided between the sloped surface and the horizontal surface, the leading end portion of the sheet stacking unit on the downstream side in the sheet conveying direction is rotatable downward and capable of dropping down the sheet or the bundle of sheets stacked on the sheet stacking unit from the leading end portion of the sheet stacking unit, and the sheet stacking unit includes a sheet stacking auxiliary surface whose end portion on the downstream side in the sheet conveying direction is positioned higher than a horizontal surface of the sheet stacking unit.

* * * * *